US008864230B2

(12) United States Patent
Augustat

(10) Patent No.: US 8,864,230 B2
(45) Date of Patent: Oct. 21, 2014

(54) ERGOMETRIC CHAIR APPARATUS

(71) Applicant: Betty A. Augustat, Broomfield, CO (US)

(72) Inventor: Betty A. Augustat, Broomfield, CO (US)

( * ) Notice: Subject to any disclaimer, the term of this patent is extended or adjusted under 35 U.S.C. 154(b) by 68 days.

(21) Appl. No.: 13/727,541

(22) Filed: Dec. 26, 2012

(65) Prior Publication Data

US 2013/0113254 A1 May 9, 2013

Related U.S. Application Data

(63) Continuation-in-part of application No. 12/816,226, filed on Jun. 15, 2010, now abandoned.

(51) Int. Cl.

| | |
|---|---|
| ***A47C 1/024*** | (2006.01) |
| ***A47C 1/038*** | (2006.01) |
| ***A47C 3/026*** | (2006.01) |
| ***A47C 7/50*** | (2006.01) |
| ***A47C 3/20*** | (2006.01) |

(52) U.S. Cl.

CPC ... *A47C 3/20* (2013.01); *A47C 7/50* (2013.01); *A47C 1/0246* (2013.01)

USPC ..... 297/300.2; 297/300.1; 297/300.3; 297/300.4; 297/300.5; 297/383; 297/423.1

(58) Field of Classification Search

USPC ..... 297/300.1, 300.2, 300.3, 300.4, 300.5, 297/285, 291, 296, 423.1, 383; 248/157, 248/161

See application file for complete search history.

(56) References Cited

U.S. PATENT DOCUMENTS

| | | | | | |
|---|---|---|---|---|---|
| 2,662,586 | A | * | 12/1953 | Cramer | 297/383 X |
| 2,956,619 | A | * | 10/1960 | Scherer | 297/383 X |
| 4,102,549 | A | * | 7/1978 | Morrison et al. | 297/383 |
| 4,198,094 | A | * | 4/1980 | Bjerknes et al. | 297/300.4 |
| 4,640,548 | A | * | 2/1987 | Desanta | 297/300.3 |
| 4,650,249 | A | | 3/1987 | Serber | |
| 4,911,501 | A | * | 3/1990 | Decker et al. | 297/300.1 X |
| 5,046,780 | A | * | 9/1991 | Decker et al. | 297/300.1 X |
| 5,110,183 | A | | 5/1992 | Jeanes, III | |
| 5,121,934 | A | * | 6/1992 | Decker et al. | 297/300.1 X |
| 5,425,566 | A | * | 6/1995 | Buchacz | 297/300.3 X |
| 5,511,852 | A | * | 4/1996 | Kusiak et al. | 297/383 X |
| 5,624,158 | A | | 4/1997 | Adat | |
| 5,839,784 | A | * | 11/1998 | Breen | 297/383 |
| 5,897,166 | A | * | 4/1999 | Tsai | 297/353 |
| 6,109,694 | A | * | 8/2000 | Kurtz | 297/300.2 X |
| 6,193,313 | B1 | | 2/2001 | Jonsson | |
| 6,394,547 | B1 | * | 5/2002 | Vik | 297/383 X |
| 6,467,848 | B1 | * | 10/2002 | Gien et al. | 297/383 X |
| 6,619,745 | B2 | * | 9/2003 | Roberts et al. | 297/383 |

(Continued)

*Primary Examiner* — Rodney B White

(74) *Attorney, Agent, or Firm* — Roger A. Jackson

(57) ABSTRACT

A chair and method of use is for a chair disposed upon a surface that is designed for a female anatomy; the chair includes a seat having proximate and distal end portions forming a first convex surface with a chord plane intersecting, the having a length shorter than its width. The chair includes a back having first and second end portions that form a second convex surface, wherein, a second lateral measure on the second end is less than a first lateral measure on the first end. The seat plane and an extension axis that is perpendicular to the surface are relatively positioned to one another to form an acute angle to one another, such that a user's femur bone lengthwise angles downward from hip to knee toward the surface while the user's shoulders arch rearward thus aligning the user's hip joint and shoulder joint vertically for better posture.

8 Claims, 19 Drawing Sheets

(56) References Cited

U.S. PATENT DOCUMENTS

| | | | | |
|---|---|---|---|---|
| 6,626,494 | B2 | 9/2003 | Yoo | |
| 6,655,731 | B2 | 12/2003 | Martin | |
| 6,659,560 | B1 * | 12/2003 | Chi | 297/383 |
| 6,938,956 | B1 | 9/2005 | Piretti | |
| 7,040,703 | B2 | 5/2006 | Sanchez | |
| 7,077,469 | B2 | 7/2006 | Badia | |
| 7,090,303 | B2 | 8/2006 | Kropa | |
| 7,104,606 | B2 | 9/2006 | Congleton | |
| 7,147,282 | B2 | 12/2006 | Hatcher | |
| 7,243,997 | B1 * | 7/2007 | Tornero | 297/383 X |
| 7,264,312 | B1 * | 9/2007 | Wang | 297/353 |
| 7,506,935 | B1 * | 3/2009 | Lin | 297/383 |
| 8,104,838 | B2 * | 1/2012 | Tsai | 297/383 X |
| 8,272,692 | B1 * | 9/2012 | Epperson | 297/300.3 |
| 8,449,035 | B2 * | 5/2013 | Breitkreuz et al. | 297/383 |
| 8,662,586 | B2 * | 3/2014 | Serber | 297/316 |
| 2002/0175553 | A1 | 11/2002 | Steifensand | |
| 2006/0290189 | A1 * | 12/2006 | Hsiao | 297/383 |
| 2010/0237674 | A1 * | 9/2010 | Lee | 297/383 |

* cited by examiner

Sitting in a conventional chair

Standing

Relaxed Side Bed Resting Position

Relaxed Side Bed Resting Position

ERGOMETRIC CHAIR APPARATUS

RELATED APPLICATION

This is a continuation in part (CIP) patent application claiming priority from U.S. patent application Ser. No. 12/816,226 filed on Jun. 15, 2010 by Betty A. Augustat of Broomfield, Colo., U.S., now abandoned.

FIELD OF INVENTION

The present invention relates to ergonomic seats or chairs, and more particularly to chairs that help support workers to reduce fatigue when performing tasks while seated for prolonged durations of time.

BACKGROUND OF THE INVENTION

There exists a need to provide ergonomic support to workers using chairs to assist in decreasing fatigue, helping in the prevention of musculoskeletal disorders (MSDs), and related issues that result from pronged durations of time spent it a seated position. In the increasing sedentary environment of the modern workplace, recent trends emerged showing an increase in chronic medical problems, such as musculoskeletal disorders (MSDs) and an increase in worker fatigue arising when workers sit for prolonged durations of time performing tasks that require the worker to sit. These problems are, in part, due to the growing dependence on computers to perform tasks in offices and increasing levels of automation in the work place that reduce the amount of manual labor in the workplace. Over time, chair design has remained largely unchanged, by not providing for the differing needs of office workers.

The negative impact of inadequate ergonomic support provided to workers during extended time periods of seating manifests primarily in two ways. The first is an increased load on the health care system, typically due to an increase in MSDs and similar ailments. The second significant impact is a loss of worker productivity through lowered worker efficiency related to loss of concentration and absenteeism in connection with the treatment of MSDs or related ailments. Additionally, extended time periods of sitting without beneficial ergonomic support leads to a decrease in efficiency once a worker becomes fatigued. Fatigue due to extended time periods of sitting can cause the worker to take more frequent breaks effectively spending less time performing work, a higher incidence of work errors, and decline in worker attitude, all combining to drive up the cost of labor to the employer. Additionally, with an aging work force, employers will likely experience additional heath benefit costs as older workers become more prone to MSDs and other ailments. These relatively large costs can be circumvented through preventative steps taken by the employer to help reduce the number of MSDs and other ailments in the workplace due to inadequate ergonomic support of workers, as well as increasing the productivity of workers. These preventive measures may include proactive steps such as stretching and other therapeutic activities in the workplace. However, reliance on such proactive steps alone is insufficient. It is difficult to ensure employees participate in such proactive measures, and it may prove difficult to encourage such behavior. As a result, providing workers with ergonomic chairs capable of passively assisting the workers from becoming prone to MSDs, other related ailments, and fatigue is preferable. The relatively small investment of properly designed chairs will allow passive assistance to the worker to combat the aforementioned emerging health problems of the modern office environment.

The prior art recognizes the problems of workplace fatigue and chronic injury related to prolonged time periods of sitting. The prior art employs a variety of techniques in an attempt to assist in alleviating seating fatigue and helping to prevent the onset of MSDs and other related ailments. The use of a contoured back structure combined with an adjustment mechanism is a common attempted solution in the prior art. However, the use of a back pad in conjunction with a means of adjustment presents difficulty in assisting workers in overcoming undesirable ergonomic conditions associated with extended time periods of sitting. First, the adjustment mechanism can be complicated to operate. Moreover, the adjustment mechanism presents a potential failure point in that the adjustment mechanism may break preventing adjustments from being made. Also, the range of adjustment may allow the worker to adjust the back into a position that may be comfortable temporarily, but after continuous use lead to fatigue. This requires the worker to either continually adjust the back, or alternatively, adjust the back to a comfortable starting position and continue to work despite the onset of fatigue, precursors to MSDs, or other related ailments. Adjustable back designs may also lead to an impediment of the full range of motion of the seated worker while performing job tasks. Furthermore, chairs are commonly too big or too small for the worker using them, leading to inappropriate sitting positions that can cause fatigue also.

An example of a prior art solution employing an adjustable seat back is in U.S. Pat. No. 6,394,547 B1 to Vik, that discloses a seat back support that is positioned between the 2nd lumbar and the 11th thoracic vertebrae of the worker. The seat back in Vik provides a horizontal and vertical component of force normal to the workers' back that acts upon the worker's back. Vik attempts to provide a simple and inexpensive ergonomic chair that provides adequate support to a worker even when the worker leans back in the chair. Vik accomplishes this end by employing an adjustable back affixed in a cantilever fashion to a seat that is positioned between the 2nd lumbar and the 11th thoracic vertebrae of the worker. While Vik accomplishes providing the worker with back support, Vik fails to teach a dimensional relationship between the back, hips, and legs of the worker. Moreover, Vik does not address any problems related to the seat of the chair, nor does Vik provide any assistance in alleviating MSDs or other ailments related to the soft tissue of the worker's legs and posterior. Also, because Vik targets a specific region of the back, and the design explicitly requires that the back pad contact the worker at a specific location, workers may either be unfamiliar with where to position the back pad, or find the position uncomfortable and fail to use the pad correctly.

Further, a prior art example that includes an adjustable backrest is U.S. Pat. No. 5,624,158 to Adat et. al., that discloses a seat backrest that is adjustable in vertical height and contour in both the curvature of upper and lower portions of the backrest. Additionally, Adat et. al. provides adjustable lateral support to the worker. Adat et. al does recognize the need to provide freedom of movement in the worker's upper body; however, the adjustment mechanisms in Adat et. al. are complicated and involves several adjustment points, as well as several mechanisms for adjustment. The various mechanical adjustment structure in Adat et. al. are all prone to unreliability issues after repeated use. While Adat et. al. provides a plurality of adjustments to the worker, Adat et. al. also presents difficulty in that the worker must spend time fine tuning the adjustment at various points to achieve a comfortable backrest position. Note that Adat et al., has no criterion disclosed as to set the various backrest adjustments for specific issues related to extended sitting fatigue and discomfort.

Similarly, in U.S. Pat. No. 6,626,494 B2 to Yoo, a chair is disclosed with an adjustable backrest assembly that is adjusted by the worker to a desired position. However, there is no limitation on the adjustment to the backrest in Yoo, making the backrest infinitely adjustable. This could lead to continual adjustments by the worker, tending to prevent correct positioning. Moreover, because the worker can be unfamiliar with what backrest position is necessary to correctly align the spine, Yoo presents an opportunity for the worker to adjust the chair backrest into a less desirable or possibly detrimental position. Without supervision by a person qualified to determine the correct orthopedic position of the chair, Yoo does not solve the need to provide ergonomic support.

A further prior art reference that attempts to simplify the adjustment of the chair backrest is U.S. Pat. No. 7,147,282 B2 to Hatcher et. al., that incorporates the adjustment structure into the backrest support structure. Hatcher et. al. allows adjustments to be made by the worker without having to awkwardly reach behind or underneath the worker to make adjustments to the chair backrest. As Hatcher et. al. only provides backrest depth adjustment with respect to the seat, the issues of multiple adjustments with multiple potential reliability issues is solved, however the need still exists to correctly position the lower body of the worker to the chair backrest. Further, in Hatcher et al., there is no method disclosed on how to set the various adjustments of the backrest for specific MSD disorder issues from prolonged sitting.

Similarly, in U.S. Pat. No. 6,938,956 B1 to Piretti discloses a double backrest support structure for a chair with the desired solution of proper back support. Piretti discloses structure to provide lumbar support to the worker through the use of two separate backrest members that, like Adat et. al., employ a variety of adjustment mechanisms to provide the worker with desired back comfort. The adjustments in Piretti provide greater complexity to the worker using the chair and can allow the worker to adjust the chair backrest members to a less desirable ergonomic position. Additionally, in Piretti the added adjustment mechanism complexity adds to the overall cost and time required to manufacture and assemble the chair, making the design less feasible for mass production. Piretti has no teachings related to specific settings for the backrest in response to particular extended sitting fatigue problems experienced by the worker.

Continuing in the prior art, a chair having again two back support portions that are each independently adjustable is disclosed in U.S. Pat. No. 7,040,703 B2 to Sanchez. In Sanchez, separate back support members attach each chair back support to the seat of the chair. Such an arrangement in Sanchez only complicates the existing problem of adjustment complexity, as to adjust the back portions to the desired position to promote ergonomic support, there are an increasing number of adjustments that need to be made by the worker, thus increasing the time required to make the adjustments and increasing the difficulty in getting the chair back support positioned to a beneficial or desirable position. Moreover, Sanchez represents increasing complexity in the manufacturability and assembly of chairs leading to increased costs of production. Also as in Piretti, Sanchez has no disclosure of a method for selecting various adjustments to better accommodate chronic fatigue problem a worker has from extended periods of sitting.

Similarly, in U.S. Pat. No. 6,655,731 B2 to Martin disclosed is an adjustment mechanism that leads to complex adjustments and difficulty in replicating the desired position. In Martin, both the chair seat and chair back are adjustable rotationally about a parallel pair of axes of each the chair seat and chair back. The chair seat and chair back are also adjustable by adjusting the chair seat and chair back to various discrete adjustment positions that are provided along the horizontal and vertical members of the frame of the chair. While the arrangement in Martin does provide increasing versatility for a variety of workers, the limited adjustment ability leads to incorrect adjustments, as well as an inability to reproduce or replicate a desirable adjustment setting once the setting has been realized. Also, Martin lacks specific teaching as to how to set the various adjustments in accordance with the various worker ailments resulting from prolonged sitting periods.

Another common solution in the prior art is the use of a seat that may have a specific size or contour. While the use of a seat of a specific shape or size does not present the aforementioned problems of the adjustable back, the particularity of each shape may not be accommodating to all workers. This requires a plurality of designs or manufacturing techniques to accommodate different workers. In this respect, some prior art has sought to assist male or female genders through various differing forms specific to either male or female genders. While particularly shaped seats may alleviate some MSDs and other ailments related to the soft tissue of the posterior of the workers, the designs do not provide for any specialized support for the worker's back. Thus there is also a need to provide specifically designed chairs that accommodate gender specific anatomy, for instance, the anatomy of a woman's body. As the shape of a woman's body is unique, a chair design should similarly reflect and conform to the specific needs of women.

A prior art reference that discusses the need to use specific structure for chairs that differ with respect to men and women is in United States patent application publication number 2002/0175553 A1 to Steifensand. Steifensand discloses two species of chairs that differ based upon the gender of the worker. While Steifensand discloses a shorter seat for the female species of the chair, Steifensand fails to provide an adapted chair back for the female. Therefore, while Steifensand recognizes the need for specifically designed chairs for the differing body contours of the male and female worker, the invention in Steifensand falls short of adequately providing a chair back that is designed specifically for the female gender.

Similarly, in U.S. Pat. No. 5,110,183 to Jeanes, III teaches how the different anatomy of female and male genders effect the proper design of chairs. Jeanes, III uses tables of data compiled to represent the respective anatomies of males and females. Additionally, Jeanes, III discloses that a shorter seat in the distance that is parallel to the femur bone is preferable to a longer seat for the anatomy of a female. However, Jeanes, III attempts to solve the problem of discomfort for the infirm or persons confined to a wheelchair; therefore, Jeanes, III does not disclose a desirable position of the back of a worker that is performing tasks. Jeanes, III provides a chair that is suited for reclining or converting to a prone position. Thus, Jeanes, III is not feasible for a worker that is required to perform tasks. Moreover, Jeanes, III teaches away from using any contour of the seat or back, but instead teaches of using a flat, planar surface for both the back and seat portions of the chair. Jeanes, III also fails to provide a specific back to seat relationship desirable to promote correct ergonomics.

Next in U.S. Pat. No. 6,193,313 B1 to Jonsson provides a unique seat structure that predisposes the worker to a position in which the legs, hips, and back are aligned in a particular way. However, Jonsson teaches that it is desirable to pivot the worker's hips toward the chair backrest such that the worker's back is driven positionally into the lumbar support of the chair. Jonsson accomplishes this position by the structure of the seat alone. The invention in Jonsson tends to create a position that leads to a slouching posture where the top of the worker's spine is arched so that the worker's shoulders are positioned forward of the hips of the worker creating a position that leads to fatigue. In addition the posture Jonsson induces may promote discomfort in the lower portion of the worker's back.

Another prior art example of the use of contour to provide ergonomic support comes in U.S. Pat. No. 7,077,469 B2 to Badia i Farre that includes a seat surface designed to be straddled by the worker such that the legs of the worker are positioned so that the worker's legs are disposed on opposite sides of the seat. Additionally, Badia i Farre incorporates voids in the seating surface to accommodate the male genitals of the worker to prevent soft tissue contact with the seat. Again, due to the unconventional method of straddling the seat, a worker may not feel comfortable with using the Badia i Farre seat. Additionally, workers that use the design in Badia i Farre may find it difficult to mount and dismount the seat. Further, especially for women, the wearing of a dress as opposed to slacks would preclude the use of this straddling of the seat.

Other prior art solutions take on unconventional designs that position workers in fundamentally different positions than a traditional chair. One such position includes providing ventral support to the worker. These designs can lead to complexity and difficulty in use, especially when the worker mounts or dismounts the chair. As an example the following prior art references use either dorsal or ventral support structures to help induce correct ergonomic position. One such reference is U.S. Pat. No. 4,650,249 to Serber. Serber discloses an office chair that uses a ventral support in combination with a seat to help induce correct ergonomic position. However, in Serber such an arrangement where ventral support is used, the positioning of the support can lead to interference with the work task movements performed by the worker, as well as difficulty sitting on the chair and returning to a standing position. However, this type of office chair design being introduced decades ago has not meet with much market acceptance most likely due to the difficulty of the worker mounting and dismounting the chair, the lack of seating position flexibility, and the potential interference of the chair with desks and other office equipment. These problems are also present in U.S. Pat. No. 7,104,606 B2 to Congleton et. al. Congleton et. al. discloses a chair that is convertible from ventral to dorsal support. Again, in Congleton et. al. when in the dorsal support arrangement, the seat and back do not properly orient the hips of the worker and when in the ventral support arrangement, the issues of sitting and standing from the chair arise, much like in Serber.

Similarly, U.S. Pat. No. 7,090,303 B2 to Kropa discloses a chair that supports the worker ventrally by providing a rest that contacts the worker's abdomen and allows the worker to perform tasks in front of the worker. The primary problem Kropa addresses is the ability to rehabilitate lower leg injuries while seating through the use of abductor and adductor type movement attachments that allow the legs to be exercised while seated. However, in Kropa again, the design presents challenges for using the chair in that worker mounting and dismounting the chair becomes awkward with the addition of the abductor and adductor type movement extensions. Also, due to the ventral support of the worker in Kropa, the design may limit the number of workers willing or able to use such a design, especially as related to limitations to use of the workers hands and arms. Again, Kropa does not teach a method of setting adjustments in response to worker fatigue stemming from extended periods of sitting.

There exists a need to provide a chair that assists in positioning a worker in a manner that promotes prevention of MSDs, other related ailments, and reduces fatigue by utilizing the shape of the seat and back in addition to the position of the seat and/or back with respect to each other. Such a chair should be simple and inexpensive to produce and use without excess adjustability that adds complexity to the overall design. Such a design should also accommodate the varying sizes of workers, yet also be able to serve a large portion of the working population effectively, without drastic changes in the design or use of the chair. One such solution to the dichotomy of providing a chair to serve a specific shape, yet also be useful to a large population of workers may be to provide a chair designed especially for the unique anatomy of the female gender. The design of a female specific chair would allow for a large population of workers to be accommodated, while still tailoring the chair to the specific needs that a female anatomy presents. Additionally, to further assist in the reduction of MSDs, related ailments, and fatigue, it is desirable to perform a series of tests to determine what position is most desirable for a worker to take while working for an extended duration of time. Such tests should focus on the ability to reduce fatigue, and seek to determine the optimal position to provide ergonomic support to a worker. An objective measure for fatigue should be developed to accurately measure what size and relative position should be realized in the seat and back to accommodate a worker. Also, to overcome the problems in the prior art of common workers having difficulty in adjusting a chair into a desirable position, a method should be developed whereby a worker can properly and simply adjust a chair into the optimal position by following steps to properly orient the workers body prior to extended durations of time.

SUMMARY OF THE INVENTION

The present invention is for a chair that is adapted for a female anatomy; the chair includes a seat having a proximate end portion and a distal end portion that forms a first substantially convex arcuate profile surface therebetween on the seat. The seat also including a length that is substantially parallel to the first substantially convex arcuate profile surface and a distance substantially transverse to the length, with the first substantially convex arcuate profile surface formed from a first partial arc of a first radius, the first radius being greater than the length. In addition, the first substantially convex arcuate profile surface includes a first seat tangential point on the proximate end portion and a second seat tangential point on the distal end portion, wherein the first seat tangential point and the second seat tangential point are at a first distance apart forming a seat plane.

Further included in the chair is a back having a first end portion and a second end portion, the first and second end portions forming a second substantially convex arcuate profile surface, the back also including a dimension substantially parallel to the second substantially convex arcuate profile surface and a first measure and a second measure both being substantially transverse to the dimension. Wherein, the second measure on the second end portion is less than the first measure on the first end portion, with the second substantially convex arcuate profile surface formed from a second partial arc of a second radius, the second radius being greater than the dimension. In addition, the second substantially convex arcuate profile surface including a first back tangential point on the first portion and a second back tangential point on the second portion, wherein the first back tangential point and the second back tangential point are at a second distance apart forming a back plane.

The seat plane and an extension axis that is perpendicular to the surface are relatively positioned to one another to form an acute angle to one another at an intersection point positioned therebetween the first seat tangential point and the second seat tangential point, in addition the seat and back are relatively positioned such that a span from the first seat tangential point to the first back tangential point is at least equal to half of said dimension. Further, a support base is disposed between the seat and the surface, and a support structure disposed between the seat and the back.

REFERENCE NUMBERS IN DRAWINGS

Figure 1:
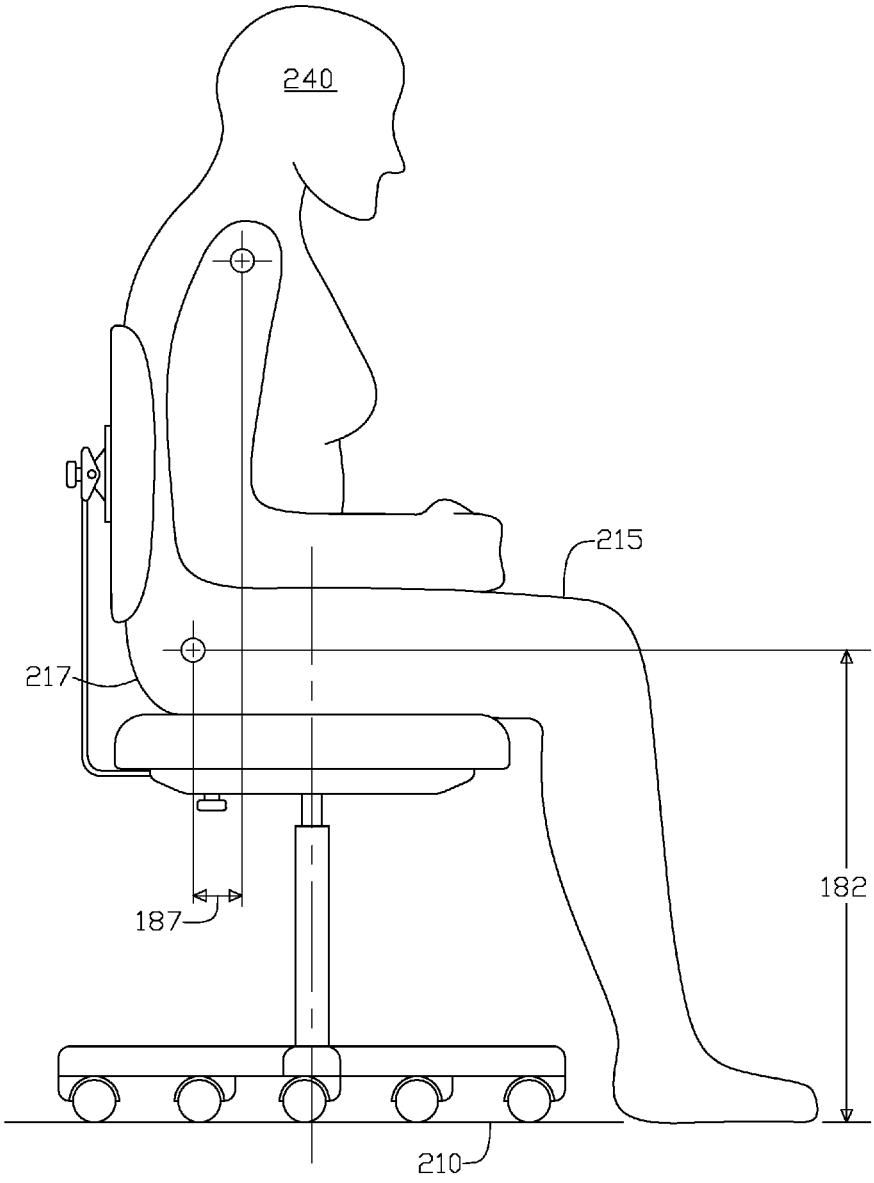
Fig.1 (Prior Art)
FIG. 1 shows a prior art side elevation view of a female chair user sitting in a typical conventional technology office chair, wherein it can seen that the femur bone lengthwise portion of the leg is parallel with the support surface with the back posture somewhat hunched over noting that the shoulder joint is not vertically aligned of the hip joint adding toward poor posture which is shown skeletally in FIGS. 2 and 3.

30 Ergometric chair apparatus adapted for a female anatomy
35 Seat
40 Proximate end portion of seat 35
45 Distal end portion of seat 35
50 First substantially convex arcuate profile surface
55 Length substantially parallel to the first substantially convex arcuate profile surface 50
60 First distance substantially traverse to the length 55
65 First radius
70 First partial arc of the first radius 65
75 First seat tangential point
80 Second seat tangential point
85 Second distance
90 Seat plane
91 Support base in-between the seat 35 and the surface 210
95 Back
100 First end portion of back 95
101 Flexible heel rest
102 Flexible partial periphery chord segment structure of the heel rest 101
103 Radial arcuate section of the heel rest 101
105 Second end portion of back 95
110 Second substantially convex arcuate profile surface
115 Dimension substantially parallel to second substantially convex arcuate profile surface 110
120 First measure of back 95
125 Second measure of back 95
130 Second radius
135 Second partial arc of the second radius 130
140 First back tangential point
145 Second back tangential point
150 Third distance
155 Back plane
156 Support structure between the seat 35 and the back 95
160 Transition from the back first end portion 100 to the back second end portion 105
165 Maximum second radius extension portion
170 Overlap as between the seat proximate end portion 40 and the maximum second radius extension portion 165
175 Extension axis that is perpendicular to the surface 210
180 Acute angle
181 Femur bone center line inclination angle that is complementary to the acute angle 180
182 Femur bone center line parallel to surface 210 in the prior art
185 Intersection point of the acute angle 180
186 Inline user shoulder joint and hip joint vertical alignment
187 Lateral offset of the user shoulder joint and hip joint vertical alignment, either forward or rearward
190 Span from the first seat tangential point 75 to the first back tangential point 140
200 High friction surface of seat 35
205 Memory foam of seat 35
210 Surface
215 User
216 Heel of the user 215
217 Buttocks of the user 215
218 Knee of the user 215
219 Rotation of user's 215 foot 221 toward the surface 210
220 Female anatomy
221 Foot of user 215
222 Foot bottom 223 of user 215 being nearly perpendicular to the surface 210
223 Foot bottom of user 215
225 Leg length of user 215
230 Waist of the user 240 or the small of the user's 240 back
235 Seat height above the surface 210
240 User sitting in the chair 30
245 Distance from the first seat tangential point 75 to the small 230 of the user's 240 back
250 Horizontal measurement of the buttocks 217 to the user's 240 waist 230 or small of the user's 240 back
255 Waist to shoulder blade distance of the user 240
265 Bottom of chair or seat 35 to waist of the user 240 distance
270 Distance from the maximum second radius extension portion 165 to transition 160
300 Inner chord portion of the flexible heel rest 101
305 Outer chord portion of the flexible heel rest 101
306 Length of outer chord portion 305
310 Radially outward extension of the flexible heel rest 101
311 Proximal portion of radially outward extension 310
312 Distal portion of radially outward extension 310
313 Affixing of the proximal portion 311 to the outer chord portion 305
314 Arched shape of the radially outward extension 310
315 Rigid static circular tube member of the flexible heel rest 101
316 Circular long axis of the tube member 315
320 Affixing of the rigid static circular tube member 315 to the support base 91
321 Angling toward seat 35 of the arched shape 314
322 Arcuate ridge of the distal portion 312
323 Parallel position of the arcuate ridge 322 to the circular long axis 316
325 Slip fit of the encompassing segment structure 102 to the tube member 315
330 Pivotal movement of the encompassing segment structure 102 about the circular long axis 316 of the tube member 315
335 Circumferential compression stress of the encompassing segment structure 102
340 Movement causing the circumferential compression stress 335 from outer chord 305 to inner chord 300
345 Circumferential tensile stress of the encompassing segment structure 102
350 Movement causing the circumferential tensile stress 345 from inner chord 305 to outer chord 300
355 Circumferential length of radial outward extension 310
360 Seat angle adjustment apparatus
365 Selectable manual mechanism
370 Locking device
375 Horizontal sliding selectable and locking clamp assembly

380 Slidable and lockable engagement to the back support element 385 from the horizontal sliding selectable and locking clamp assembly 375
381 Handle for making slidable and lockable engagement 380
382 Rotating the handle 381 via manually grasping by the user 215
385 Back support element
390 Horizontal movement
395 Vertical sliding selectable and locking clamp assembly
400 Slidable and lockable engagement on back support element 385 from the vertical sliding selectable and locking clamp assembly 395
401 Handle for making slidable and lockable engagement 400
402 Rotating the handle 401 via manually grasping by the user 215
405 Vertical movement
410 Internally threaded element
415 Externally threaded rod
420 Proximal end portion of the externally threaded rod 415
425 Distal end portion of the externally threaded rod 415
430 Pivotal and rotatable connection of the proximal end portion 420
435 Handle
440 Rotating the handle 435 via manually grasping by the user 215
445 Adjustment of the seat plane 90 acute angle 180
450 Loose internally threaded body
455 Radial outward beam of the loose internally threaded body 450
460 Tightly contact as between the loose internally threaded body 450 and the internally threaded element 410
461 Movement to cause tightly contact 460 at beam 455
465 Axial tension of the threaded rod 415 via the tightly contact 460 to rotationally lock externally threaded rod 415 within the internally threaded element 410 thus locking the seat plane 90 acute angle 180
470 High friction annular ring

DETAILED DESCRIPTION

Figure 2:
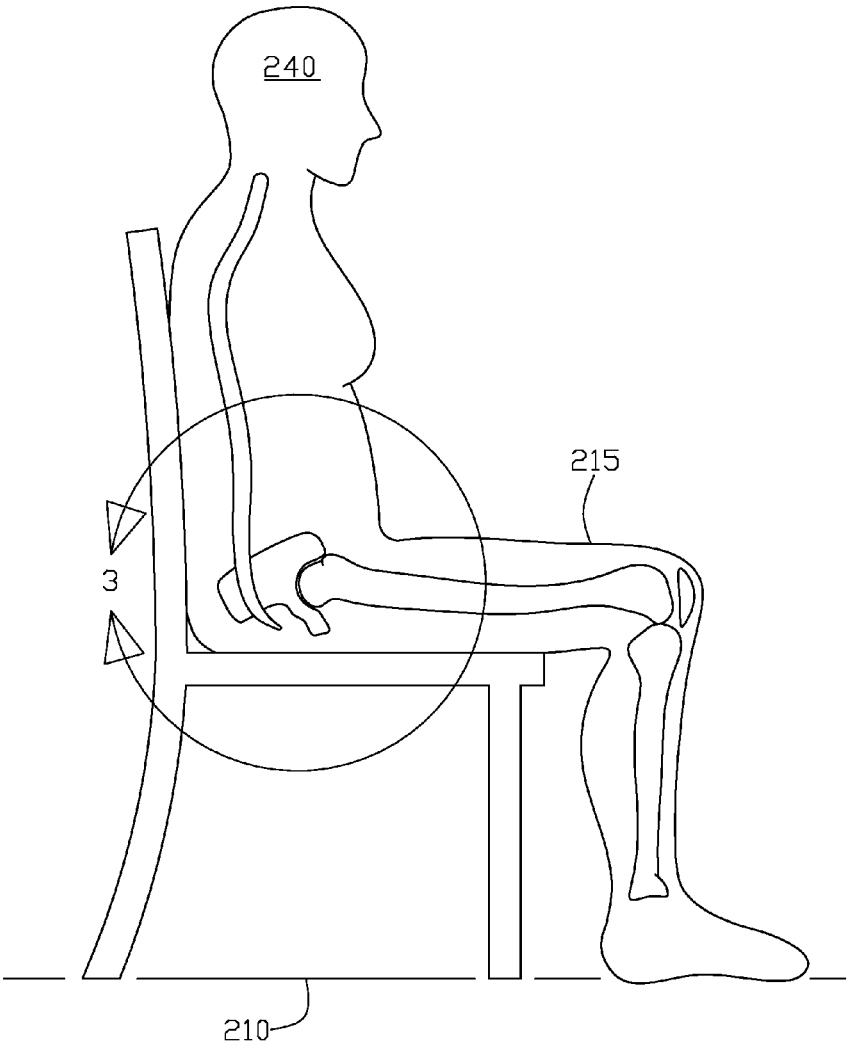
Fig.2 (Prior Art)
FIG. 2 side elevation view of a skeletal structure from FIG. 1, with the female chair user sitting in a typical conventional technology office chair, wherein it can seen that the Femur bone lengthwise portion of the leg is parallel with the support surface with the back posture somewhat hunched over making for poor posture, noting that the pivotal movement of the Femur bone in the hip joint is limited to about sixty (60) degrees, thus from the standing position as shown in FIGS. 4 and 5, the user leg upper portion can move from standing to sitting through an arc of about sixty (60) degrees or in other words about thirty (30) degrees short of the standard sitting position on the Femur bone lengthwise being at ninety (90) degrees to the back bone as shown in FIGS. 1, 2, and 3, thus the Femur bone lengthwise must bend the pelvis and the back bone for the last thirty (30) degrees of movement to achieve the ninety (90) sitting position in FIGS. 1, 2, and 3, this results in the situation wherein the discs have unequal spacing as between the bones, see especially FIG. 3, which can be termed a Kyphosis operational state, wherein the pressure placed upon the disc increases significantly from their uneven edge loading, being up to a 400% increase in disc pressure from the standing position in FIGS. 4 and 5 to the high forward leaning positions for the back as seated in FIGS. 1, 2, and 3.
Figure 3:
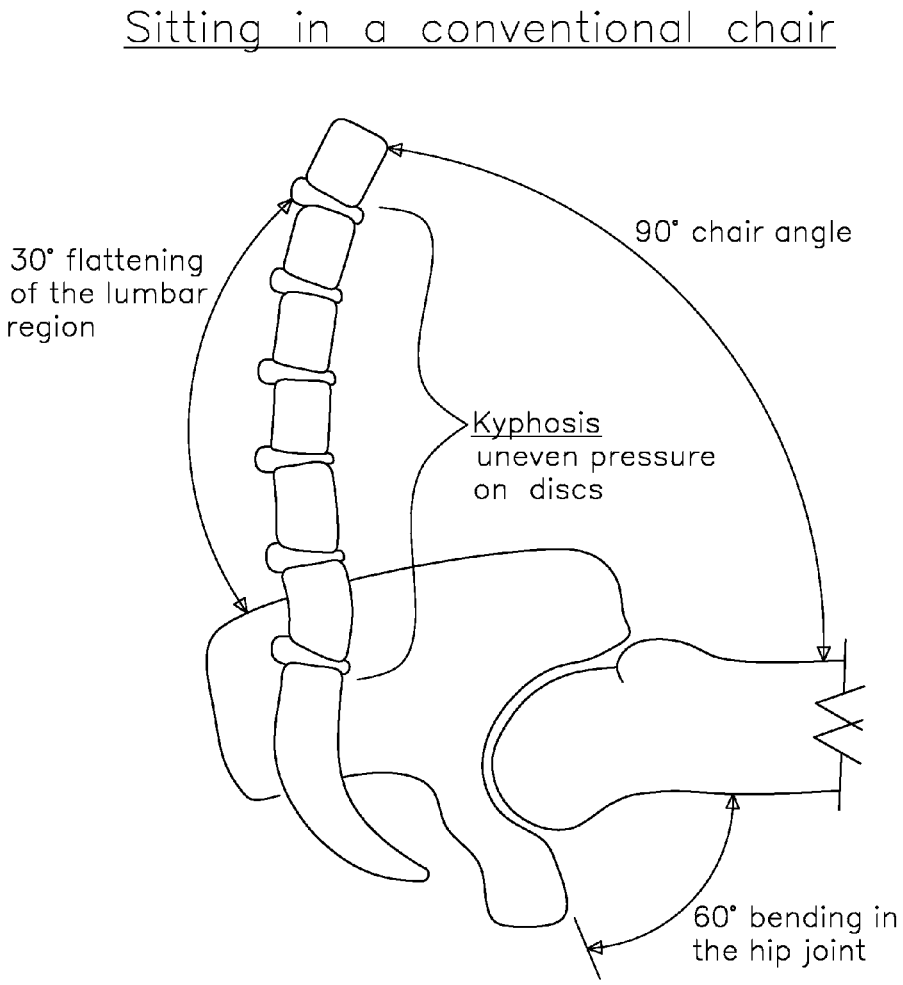
Fig.3 (Prior Art)
FIG. 3 shows expanded view 3-3 from FIG. 2 detailing out the femur bone, pelvic, and discs area, wherein it can be more clearly seen that the femur bone being parallel to the support surface causes the pelvic bone to rotate counter clockwise putting the discs in a hunched-over position in an arcuate posture opposite from that of the standing position as shown in FIGS. 4 and 5, with this being combined with the conventional chair user tending to lean somewhat forward causes the portions of the discs adjacent to the femur to be compressed axially more than the portion of the discs oppositely positioned, resulting in the undesirable aforementioned increase in disc pressure which can be termed the Kyphosis operational state.

With initial reference to FIG. 1 shown is a prior art side elevation view of a female chair user 240 sitting in a typical conventional technology office chair, wherein it can seen that the femur bone lengthwise portion of the leg is parallel 182 with the support surface 210, with the back posture somewhat hunched over, noting that the shoulder joint is forward 187 of the hip joint, adding toward poor posture which is shown skeletally in FIGS. 2 and 3.

Figure 4:
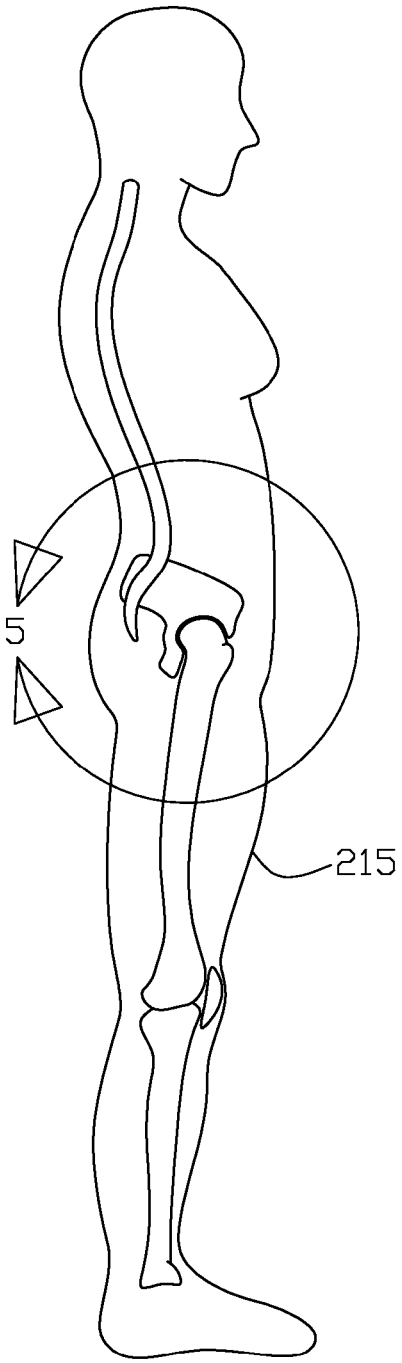
FIG. 4 shows a side elevation view of a skeletal section of a normal human in a standing position, showing the most natural posture of the upper portion of the femur bone, the pelvis and the backbone, wherein the backbone is in a Lordosis operational state with the lumbar curve in its natural state, or more importantly that the discs of the back have equal spacing around their entire periphery as between the disc and the bone resulting in more equal pressure placed upon the discs which is desirable, as when the discs have unequal spacing as between the bones, which can be termed the Kyphosis operational state, see FIGS. 2 and 3, wherein the pressure placed upon the disc increases significantly, being up to a 400% increase in disc pressure from the standing position to high forward leaning positions for the back.
Figure 5:
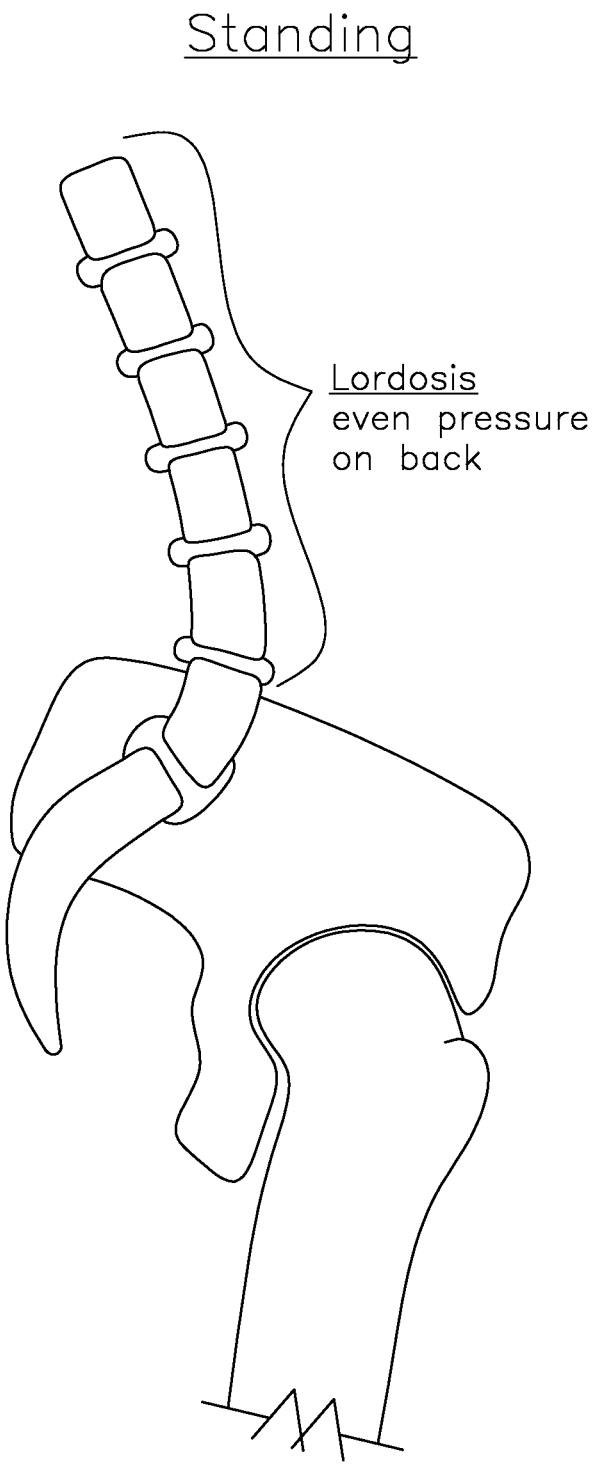
FIG. 5 shows expanded view 5-5 from FIG. 4 detailing out the femur bone, pelvic, and discs area, wherein it can be more clearly seen that the femur bone position in the normal standing attitude resulting in the pelvic bone is in its natural positional state putting the discs in the evenly spaced state around their entire periphery, wherein the backbone is in the Lordosis operational state with the lumbar curve in its natural state.

Continuing, as the basis for FIGS. 2, 3, 4, 5, 6 and 7, in a study completed by German orthopedic surgeon, Hanns Schoberth in 1962, x-rays were taken in showing that the femur has about sixty (60) degrees of pivotal movement in relation to the pelvis, meaning that when an individual moves into a seated position requiring a ninety (90) degree angle of femur movement from standing for instance, in relation to the pelvis necessitates that the pelvis and the lumbar curve must accommodate the additional thirty (30) degrees of movement, with this additional bending occurring between the $4^{th}$ and $5^{th}$ lumbar discs, see FIGS. 2 and 3. Thus, in FIGS. 4 and 5 shown is a side elevation view of a skeletal section of a normal human in a standing position, showing the most natural posture of the upper portion of the femur bone, the pelvis, and the backbone, wherein the backbone is in what could be termed a Lordosis operational state with the lumbar curve in its natural state, or more importantly that the discs of the back have equal spacing as between each of the disc and the bone adjacent sets, resulting in a more equal pressure distribution placed upon each of the discs which is desirable. This is as opposed to when the discs have unequal spacing as between the bones, which can be termed the Kyphosis operational state, see FIGS. 2 and 3, wherein the pressure placed upon each disc can increase significantly being up to a 400% increase in disc pressure from the standing position to undesirable high forward leaning positions for the back.

Figure 6:
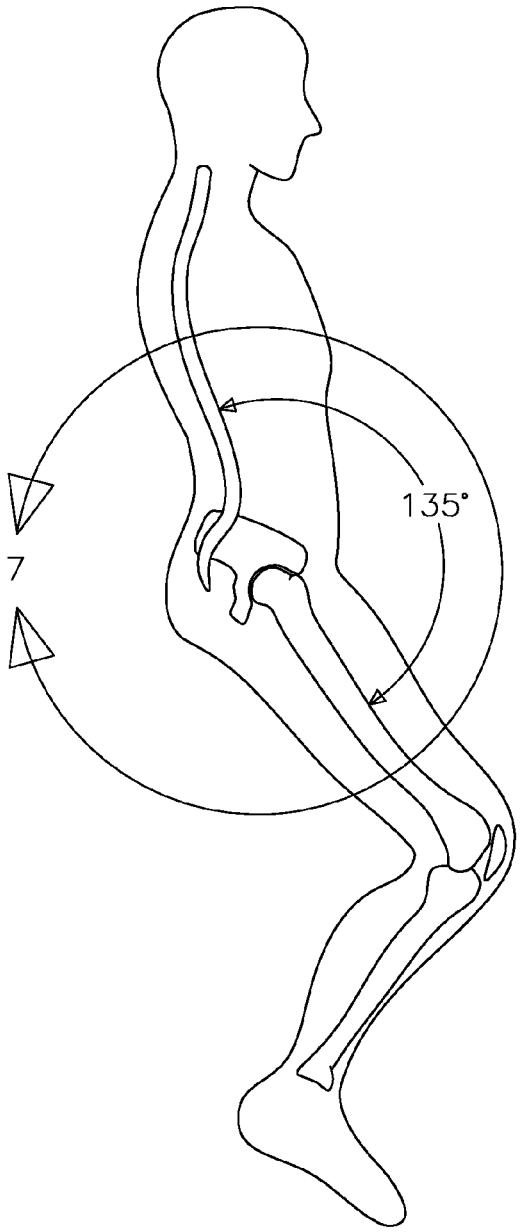
FIG. 6 shows a side elevation view of a skeletal section of a normal human in a laying on their side relaxed position, such that there is no gravitational force on the skeletal structure that would be bearing upon the feet upward, as in a normal standing attitude, thus this relaxed on the side laying position showing the most natural default positional posture of the upper portion of the femur bone, wherein the femur bone is at one-hundred and thirty-five (135) degrees of angle from the back bone, plus the pelvis and the backbone, wherein the backbone again is in what can be termed the Lordosis operational state with the lumbar curve in its natural state, or more importantly that the discs of the back have equal spacing as between the disc and the bone resulting in more equal pressure placed upon the discs which is desirable, as opposed to again as when the discs have unequal spacing as between the bones, which can be termed the Kyphosis operational state, wherein the pressure placed upon the disc increases significantly being up to a 400% increase in disc pressure from the standing position to high forward leaning positions for the back.
Figure 7:
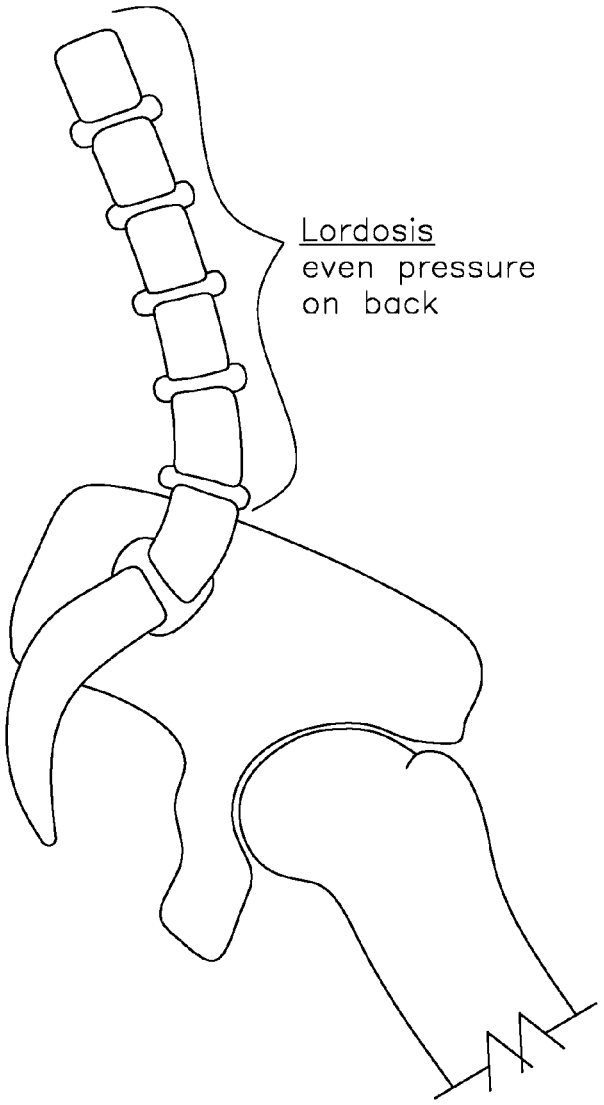
FIG. 7 shows expanded view 7-7 from FIG. 6 detailing out the femur bone, pelvic, and discs area, wherein it can be more clearly seen that the femur bone position in the normal laying on the side position resulting in the pelvic bone is in its natural positional state putting the discs in the evenly spaced state around their entire periphery, wherein the backbone is in the Lordosis operational state with the lumbar curve in its natural state.

Further, referring specifically to FIGS. 6 and 7 in a study conducted by American orthopedic surgeon J. J. Keegan in 1953, in a series of x-rays of people laying on their sides in documenting the movements in the lumbar section of the spinal column, FIGS. 6 and 7 show a side elevation view of a skeletal section of a normal human in a relaxed laying on their side position, such as resting in a bed, such that there is no gravitational force on the skeletal structure in its normal vertical axis, i.e. as in standing, thus FIGS. 6 and 7 showing the most natural default positional posture of the upper portion of the femur bone, wherein the femur bone lengthwise is positioned at one-hundred and thirty-five (135) degrees of angle from the back bone as shown. Thus in FIGS. 6 and 7, as shown in the pelvis and the backbone positioning, wherein the backbone again is in what can be termed a Lordosis operational state with the lumbar curve in its natural state, or more importantly that the discs of the back have the desirable equal spacing as between each of the disc and the bone adjacent sets resulting in a more equal pressure distribution placed upon the discs which is desirable, again as opposed to when the discs have the undesirable unequal spacing as between the adjacent bones, which can be termed the Kyphosis operational state, see FIGS. 2 and 3, wherein the pressure placed upon the disc increases significantly being up to a 400% increase in disc pressure from the standing position to high forward leaning positions for the back, see FIGS. 1, 2, and 3.

Referring again to FIGS. 2 and 3, for the side elevation view of a skeletal structure from FIG. 1, with the female chair user 240 sitting in a typical conventional technology office chair, wherein it can seen that the Femur bone lengthwise portion of the leg is parallel 182 with the support surface 210 with the user's 240 back posture somewhat hunched over making for poor posture, noting that the pivotal movement of the Femur bone in the hip joint is limited to about sixty (60) degrees, as previously discussed, thus from the standing position as shown in FIGS. 4 and 5, the user 215 leg upper portion can move from standing to sitting through an arc of about sixty (60) degrees or in other words about thirty (30) degrees short of the standard ninety (90) degree sitting position on the Femur bone lengthwise being positioned at ninety (90) degrees as shown in FIGS. 1 and 2. Thus, as FIGS. 2 and 3 show, the Femur bone lengthwise must bend the pelvis and the back bone for the last thirty (30) degrees of movement to achieve the ninety (90) sitting position as shown in FIGS. 1 and 2, this results in the situation wherein the discs have unequal spacing as between the adjacent bones, which can be termed the Kyphosis operational state, wherein the pressure placed upon the disc increases significantly being up to a 400% increase in disc pressure from the standing position to high forward leaning positions for the back in the user 240, see FIGS. 1, 2, and 3.

Figure 8:
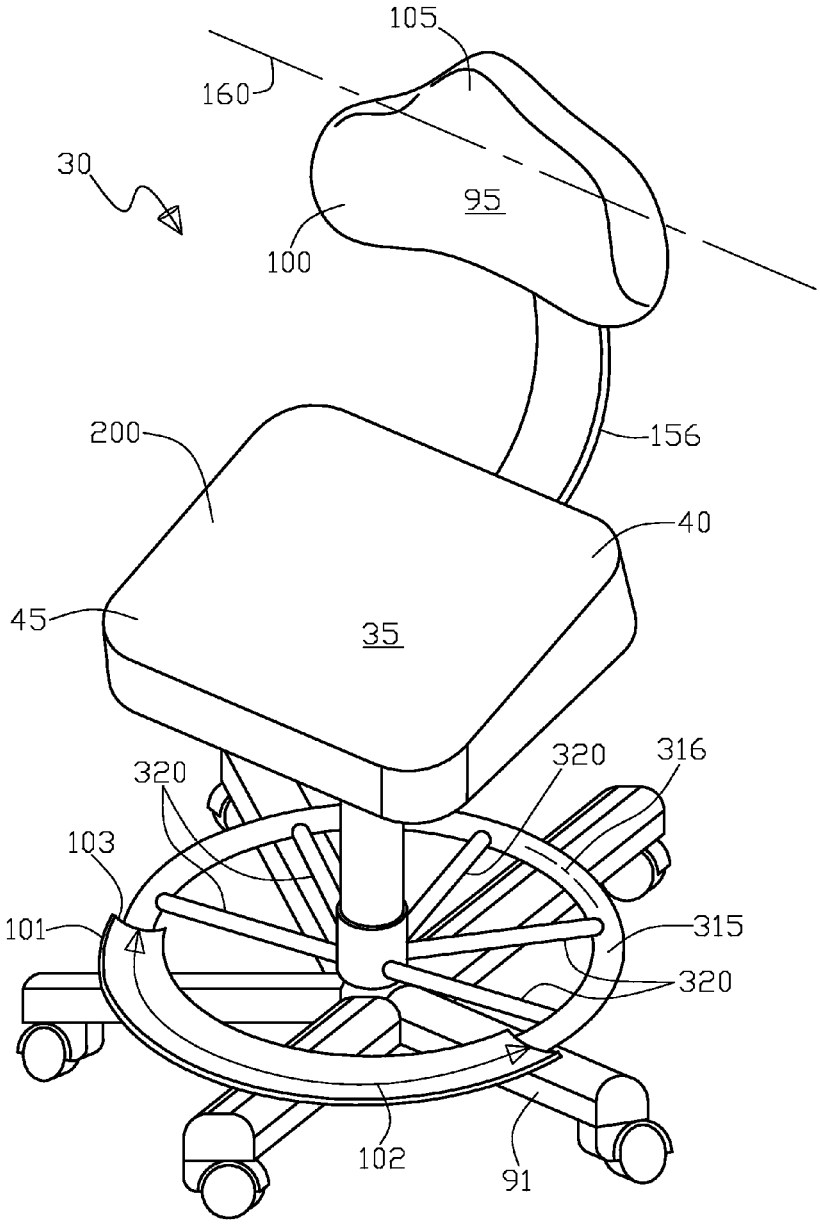
FIG. 8 shows a perspective view of the present invention of the chair adapted for the female anatomy, noting the downward sloping seat away from the back to the support surface to allow the user's knees to be positioned below the hip, wherein the chair back has a great amount of spacing away from the seat to allow for a slight back arching, further to accommodate space for the user's buttocks, and the back having an upper narrow portion to accommodate non binding movement of the user's shoulder blades as the user's arms are moved for work motions, i.e. using a keyboard and the like, further a foot rest is shown, that is formed as a partial periphery chord segment that has a radial arcuate section for receiving a user's heel.
Figure 9:
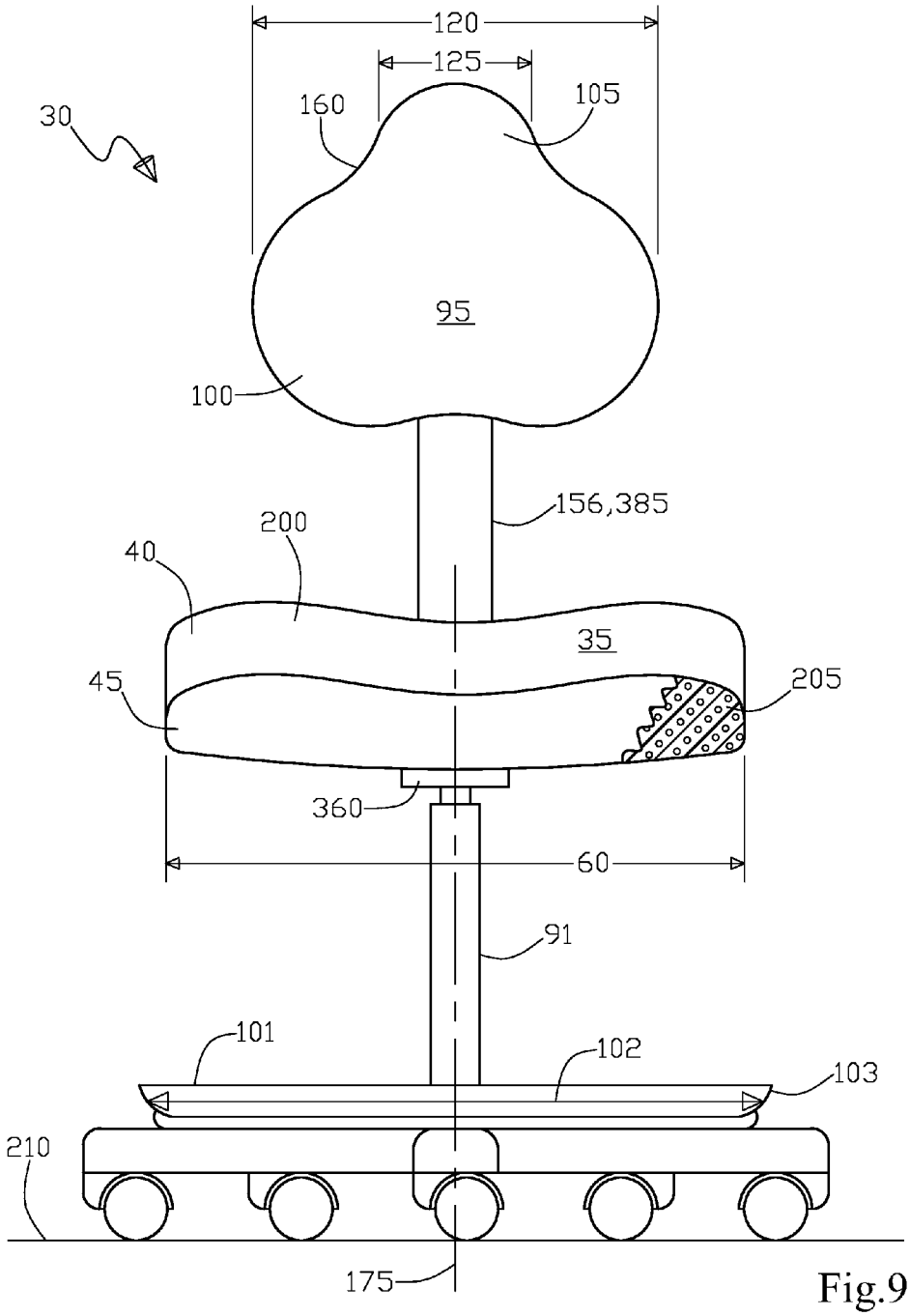
FIG. 9 shows a front elevation view of the present invention of the chair adapted for the female anatomy, again noting the downward sloping seat away from the back to allow the user's knees to be positioned below the hip, wherein the back has a great amount of spacing away from the seat to allow for a slight back arching, further to accommodate space for the user's buttocks, and the back having an upper narrow portion to accommodate non binding movement of the user's shoulder blades, further the foot rest is shown, that is formed as the partial periphery chord segment that has the radial arcuate section for receiving the user's heel.

Yet further, in FIG. 8 shown is a perspective view of the present invention of the chair 30 adapted for the female anatomy 220, noting the downward sloping chair seat 35 away from the chair back 95 to allow the user's 240 knees to be positioned below their hip, wherein the chair back 95 has a great amount of spacing via a span 190 away from the seat 35 to allow for the slight back arching of the user 240, further to accommodate space for the user's 240 buttocks 217, and the chair back 95 having an upper narrow portion or second measure 125 to accommodate non binding movement of the user's 215 shoulder blades. Further a flexible heel rest 101 is shown, that includes a flexible partial periphery chord segment structure 102 and that has a radial arcuate section 103 for receiving a user's 215 heel 216, see FIGS. 10, 11, 12, 16 and 17. Continuing, FIG. 9 shows a front elevation view of the present invention of the chair 30 adapted for the female anatomy 220, again noting the downward sloping chair seat 35 away from the chair back 95 to allow the user's 240 knees to be positioned below their hip, wherein the chair back 95 has a great amount of spacing or span 190 away from the chair seat 35 to allow for the user 240 back to slightly arch to form a type of swayback curve at the small 230 of the user's 240 back bone, further to accommodate space for the user's 240 buttocks 217, and the chair back 95 having an upper narrow portion or second measure 125 to accommodate non binding movement of the user's 240 shoulder blades. Further the flexible heel rest 101 is shown, that includes the flexible partial periphery chord segment structure 102 and that has a radial arcuate section 103 for receiving a user's 215 heel 216, see FIGS. 10, 11, 12, 16, and 17.

Figure 10:
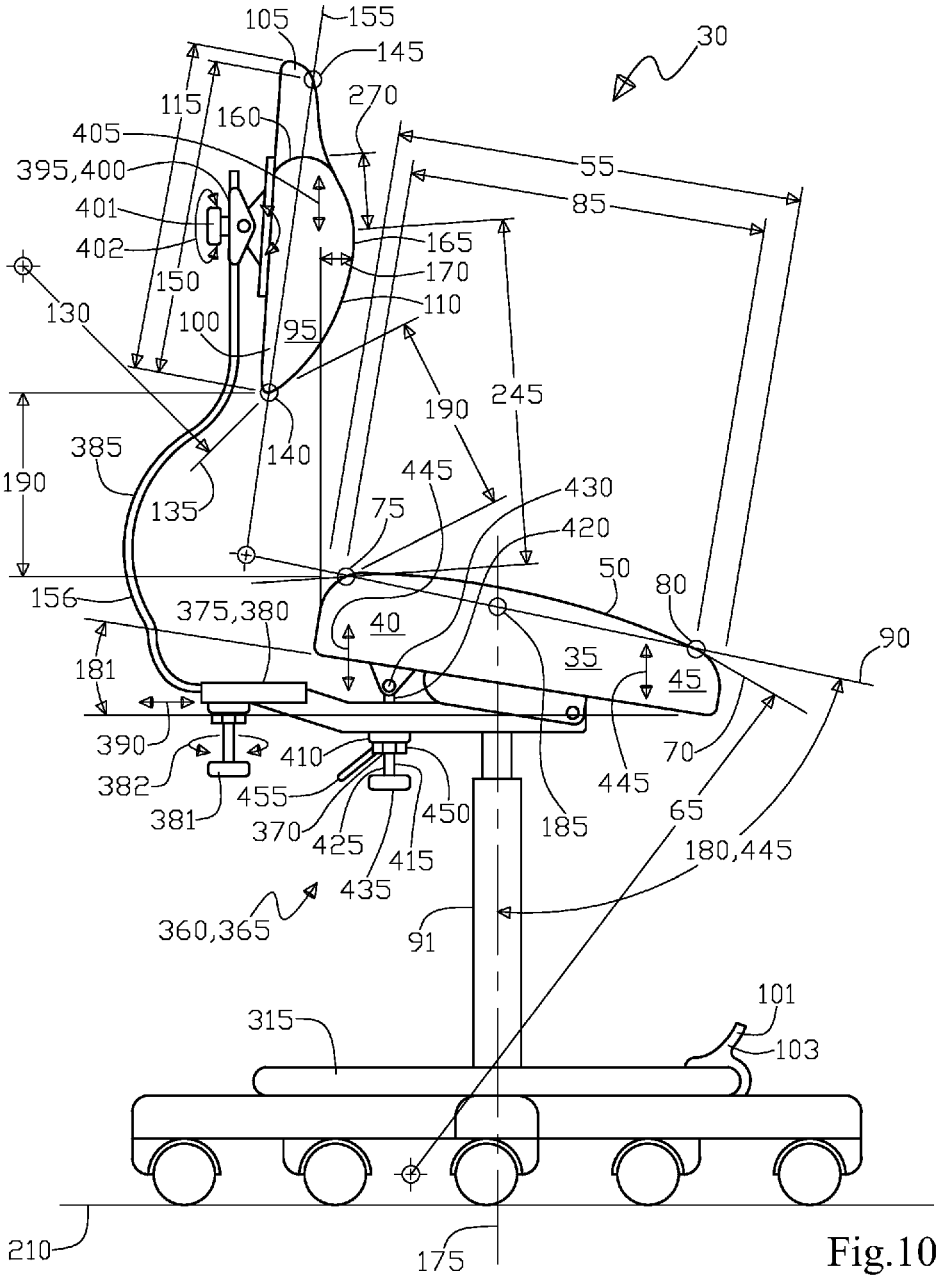
FIG. 10 shows a side elevation view of the present invention of the chair adapted for the female anatomy, again noting the shorter in length from the rear proximal portion to the front distal portion downward sloping seat at an angle going from the rear of the seat to the front of the seat, again to allow the user's knees to be positioned below the hip, wherein the back has a span of spacing away from the seat to allow for the user to have the slight back arching, further to accommodate space for the user's buttocks, wherein the chair back is positioned to nest in the small of the back of the user to further support a better skeletal posture for the user sitting in the present invention chair, further the foot rest is shown, that is formed as the partial periphery chord segment that has the radial arcuate section for receiving the user's heel.
Figure 11:
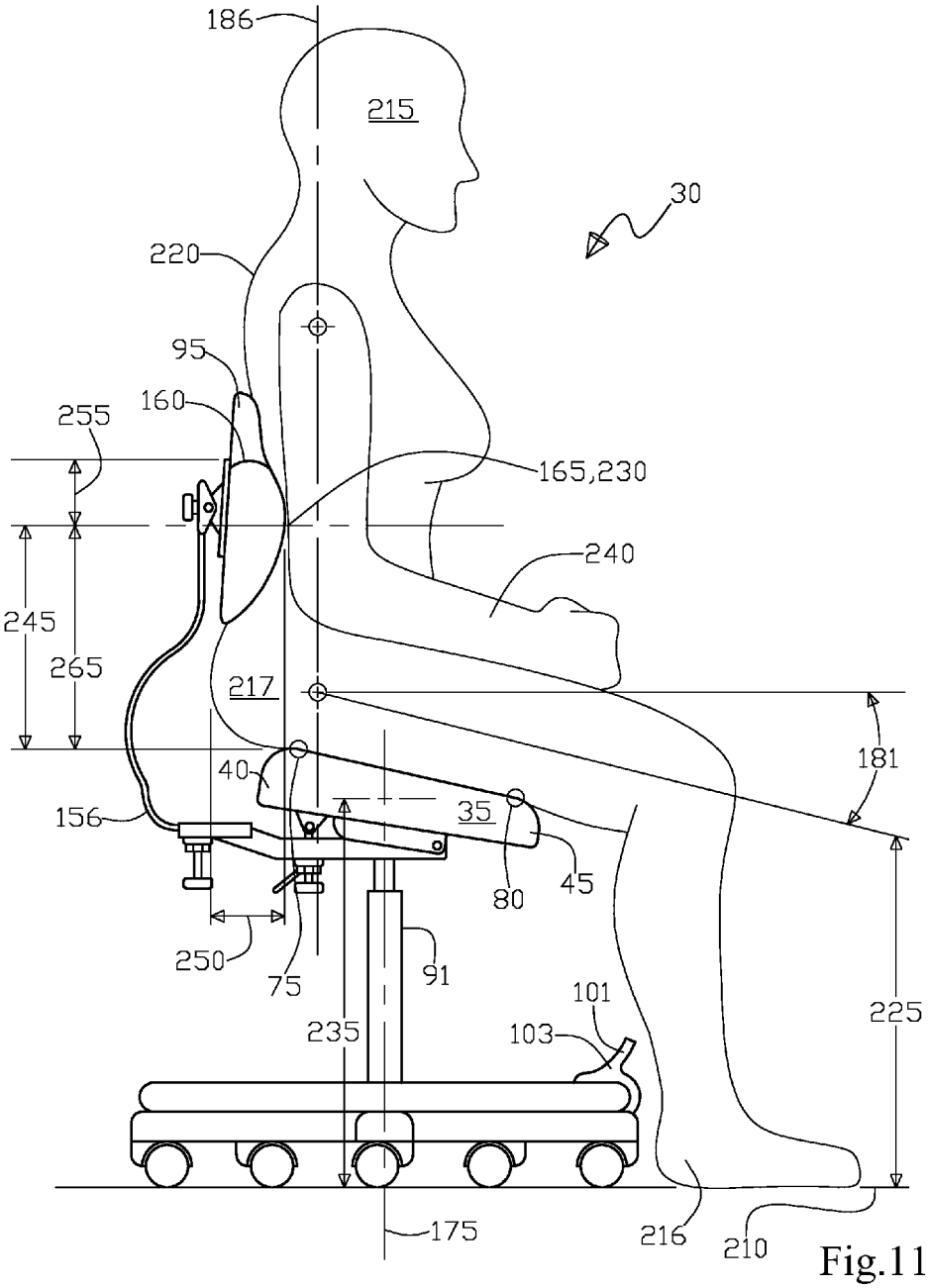
FIG. 11 shows the same side elevation view as FIG. 10, with the user in position in the chair with their legs between the hip and knee being angled downward toward the floor surface, plus showing the span of the free and open space as between the seat and back for the user's hips and lower back open space to slightly arch rearward, further to accommodate space for the user's buttocks, and the chair back nesting in the small of the user's back for support on the user's skeletal structure to approach the more ideal back positioning as shown in FIGS. 2 and 3, further the foot rest is shown, that is formed as the partial periphery chord segment that has the radial arcuate section for receiving the user's heel.

Continuing, FIG. 10 shows a side elevation view of the present invention of the chair 30 adapted for the female anatomy 220, again noting the shorter in length 55 from the rear proximal portion 40 to the front distal portion 45 downward sloping angle 180 seat at an angle 181 going from the rear 40 of the seat 35 to the front 45 of the seat 35, again to allow the user's 240 knees to be positioned below the hip, wherein the chair back 95 has a span 190 of spacing away from the seat 35 to allow for user 240 slight back arching or creating the small of the back 230 curve, wherein the chair back 95 is positioned to nest in the small of the back 230, allowing free space for the user's 215 buttocks 217 to not be impeded by the chair back 95, resulting in the user 240 being able to further support a better skeletal posture for the user 240 sitting in the present invention chair 30, see also FIGS. 11 and 12. Further the flexible heel rest 101 is shown, that includes a partial periphery chord segment structure 102 and that has a radial arcuate section 103 for receiving a user's 215 heel 216, see FIGS. 10, 11, 12, 16, and 17. Continuing, FIG. 11 shows the same side elevation view as FIG. 10, with the user 240 in position in the chair 30 with their legs between the hip and knee being angled 181 downward toward the floor surface 210, plus showing the span 190 of the free and open space as between the seat 35 and back 95 for the user's 240 hips and lower back open space to slightly arch rearward 230 allowing free space for the user's 215 buttocks 217, and with the chair back 95 nesting in the small 230 of the user's 240 back for support on the user's 240 skeletal structure to approach the more ideal back positioning as shown in FIGS. 6 and 7. Further the flexible heel rest 101 is shown, that includes a partial periphery chord segment structure 102 and that has a radial arcuate section 103 for receiving a user's 215 heel 216, see FIGS. 10, 11, 12, 16, and 17.

Figure 12:
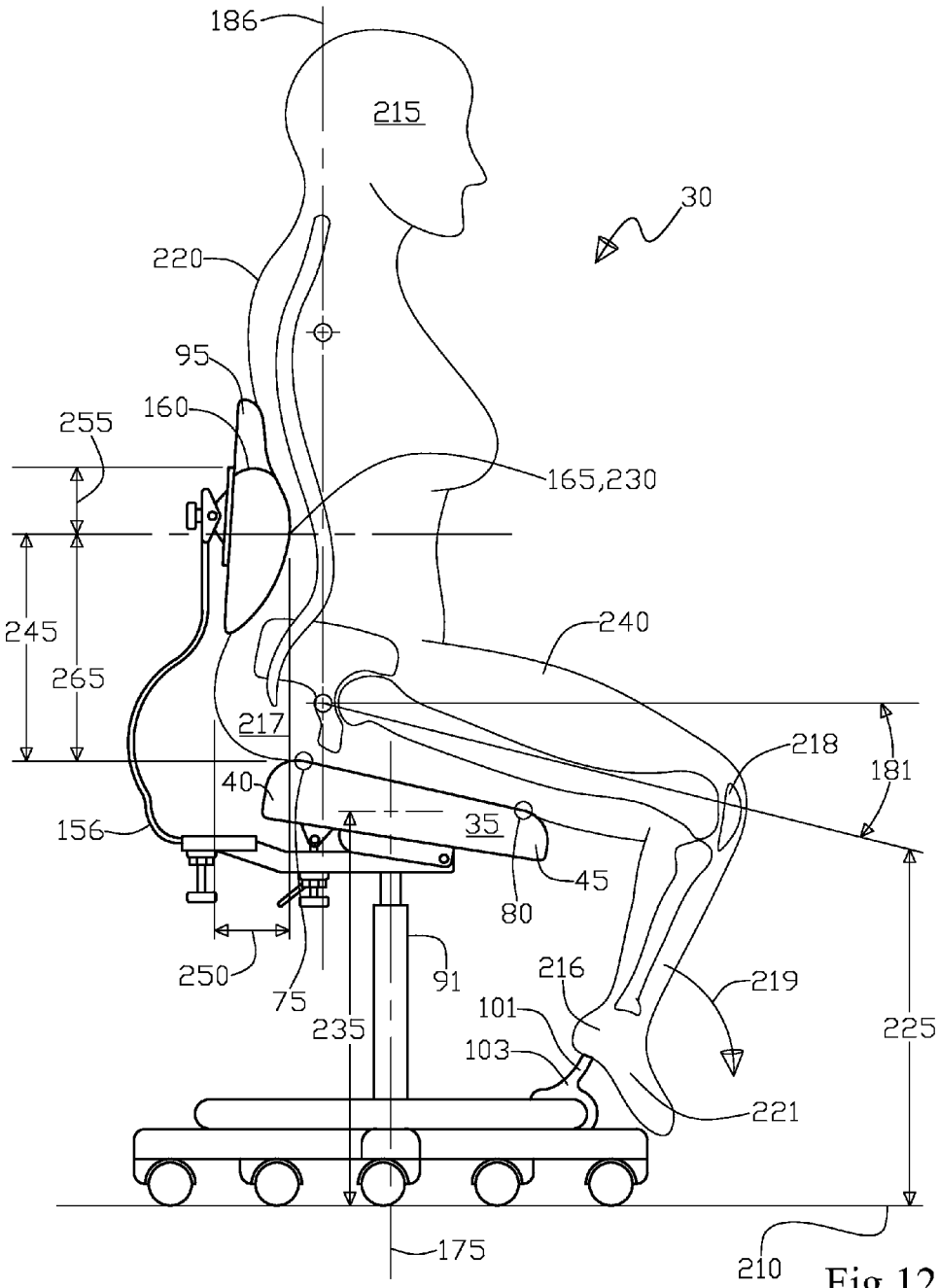
FIG. 12 shows the same side elevation view as FIG. 11, with the addition of a skeletal cross section of the user in position in the chair with their legs or the femur bone between the hip and knee being angled downward toward the floor surface, plus showing the span of the free and open space as between the seat and back for the user's hips and lower back open space to slightly arch rearward, further to accommodate space for the user's buttocks, and the chair back nesting in the small of the user's back for support on the user's skeletal structure to approach the more ideal back positioning as shown in FIGS. 6 and 7, further, the positional relationship of the femur to the pelvis to the discs is also shown, that is between the Lordosis and Kyphosis positions as previously described, further the foot rest is shown, that is formed as the partial periphery chord segment that has the radial arcuate section for receiving the user's heel.

Next, FIG. 12 shows the same side elevation view as FIG. 11, with the addition of a skeletal cross section of the user 240 in position in the chair 30 with their legs or the femur bone between the hip and knee being angled downward 181 toward the floor surface 210, plus showing the span 190 of the free and open space as between the seat 35 and back 95 for the user's 240 hips and lower back open space to slightly arch rearward 230, allowing free space for the user's 215 buttocks 217, and with the chair back 95 nesting in the small 230 of the user's 240 back for support on the user's 240 skeletal structure to approach the more ideal back positioning as shown in FIGS. 6 and 7, further, the positional relationship of the femur to the pelvis to the discs is also shown, that is between the Lordosis and Kyphosis positions as previously described. Thus given that the user's 215 upper legs and femur bone angle downward 181 helps reduce the thirty (30) degree angle that the pelvis must normally take up, as shown in FIGS. 2 and 3, thus helping to alleviate the uneven disc pressure as shown in FIGS. 2 and 3, with there being a comfort limit as to how large of an angle 181 can be tolerated without the user 215 sliding forward in the seat 35. Further the flexible heel rest 101 is shown, that includes the flexible partial periphery chord segment structure 102 and that has a radial arcuate section 103 for receiving a user's 215 heel 216, see FIGS. 10, 11, 12, 16, and 17.

Figure 13:
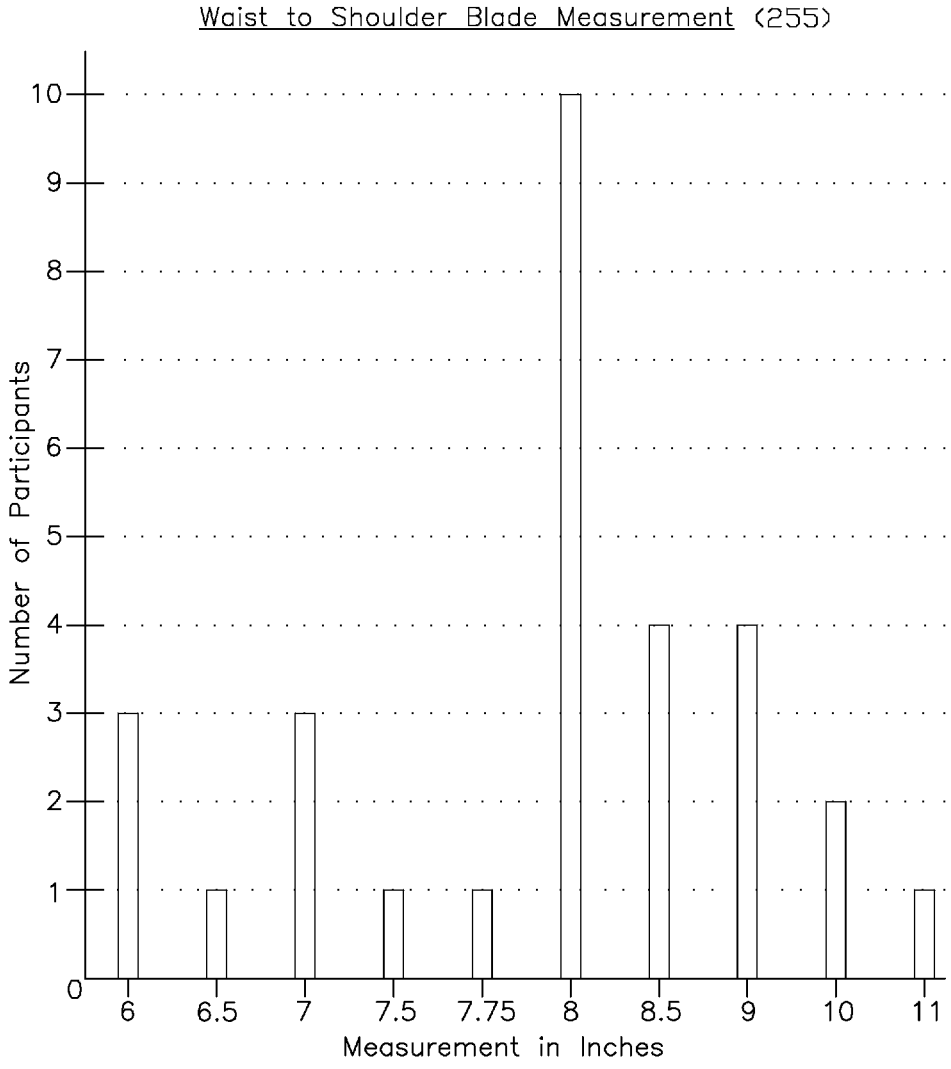
FIG. 13 shows a compilation of raw data samples taken of women for the scope of distances as between their waist and their shoulder blades with a quasi somewhat bell shape statistical variance curve of variation of this measured distance, wherein it was shown that the majority of the thirty (30) test sample subjects came in at a distance of about 8.06 inches, this was done to determine the range of adjustment movement vertically of the back and for the upper of second portion narrowing of the back to accommodate clearance for the user's shoulder blades.
Figure 14:
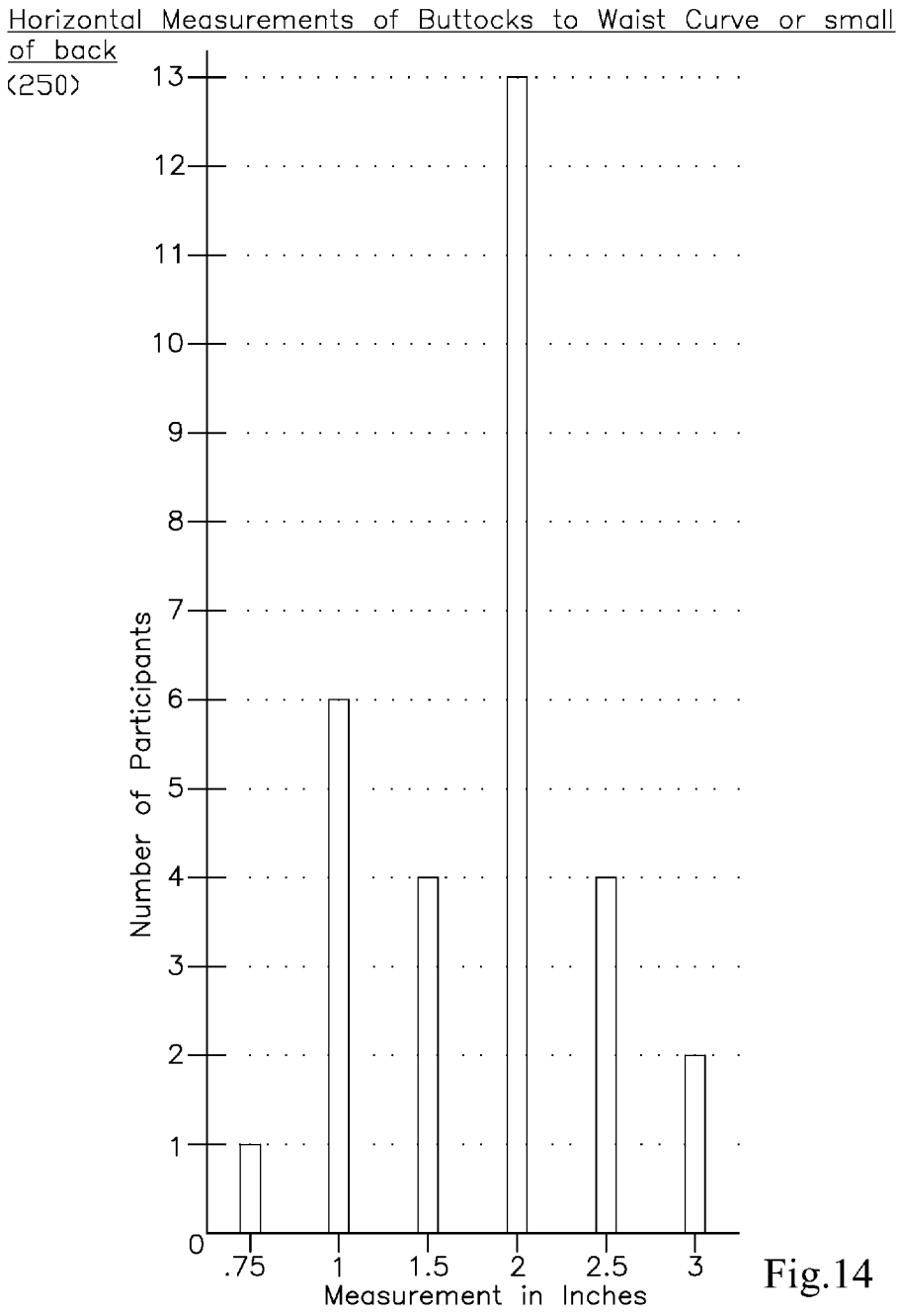
FIG. 14 shows another compilation of raw data samples taken on a group of thirty (30) participants for the scope of distances from their waist to the curve or the small of their backs for determining placement of the maximum second radius extension portion or largest protrusion portion of the back to enable the nesting of this protrusion portion in the small of the back for the user, the mean distance for the waist to small of the back distance was 1.83 inches.
Figure 15:
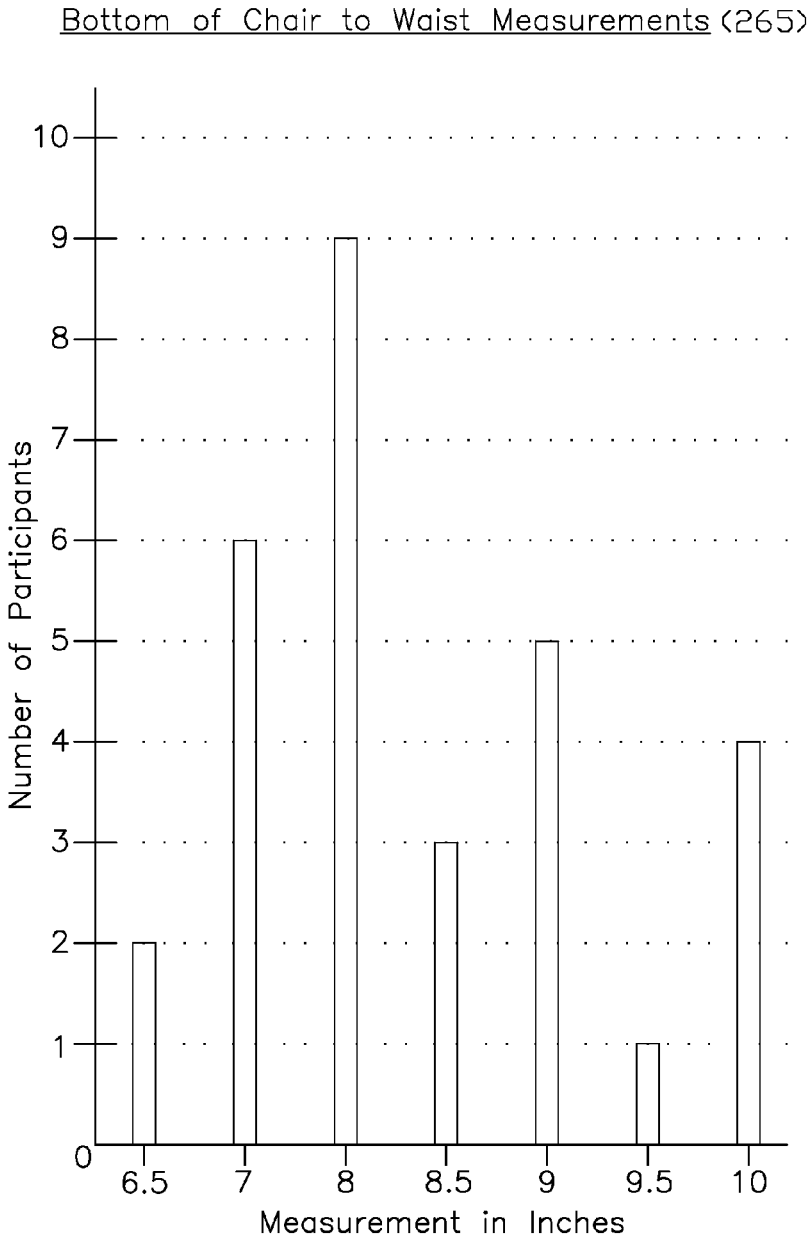
FIG. 15 shows a further compilation of raw data samples also taken on a group of thirty (30) participants for the scope of distances from the bottom of the chair of seat portion to their waists, for the purpose of enabling the measurements as taken in FIGS. 13 and 14 to be associated with the chair structure itself, wherein the distance from the bottom of the chair seat portion to the users waists had a mean of 8.23 inches.

Further, FIG. 13 shows a compilation of raw data samples taken of women for the scope of distances as between their waist and their shoulder blades 255 with a quasi somewhat bell shape statistical variance curve of variation of this measured distance 255, wherein it was shown that the majority of the thirty (30) test sample female subjects came in at a distance of about 8.06 inches as between the waist and shoulder blades 255, this was done to determine the range of adjustment movement vertically of the back 95 and for the upper of second portion 105 narrowing second measure 125 of the chair back 95 to accommodate clearance for the user's 240 shoulder blades. Next, FIG. 14 shows another compilation of raw data samples taken on a group of thirty (30) female participants for the scope of distances being horizontal measurements of the user's 240 buttocks 217 to the user's 240 waist 230 or small of the back defined as distance 250 for determining placement of the maximum second radius extension portion 165 or largest protrusion portion of the chair back 95 to enable the nesting of this protrusion portion 165 in the small of the back 230 for the user 240, wherein the mean distance for the waist to small of the back distance 250 was 1.83 inches. Next, FIG. 15 shows a further compilation of raw data samples also taken on a group of thirty (30) female participants for the scope of distances from the bottom of the chair or seat 35 portion to their waists 265, for the purpose of enabling the measurements as taken in FIGS. 13 and 14 to be associated with the chair 30 structure itself, wherein the distance 265 from the bottom of the chair seat 35 portion to the users 240 waists had a mean of 8.23 inches. Note that the dimension for the 265 measurement, the seat thickness is included, thus in say taking a measurement from the seat proximal end portion 40 or the first set tangential point 75, upward the seat thickness should be subtracted from dimension 265, being about four (4) inches.

Figure 16:
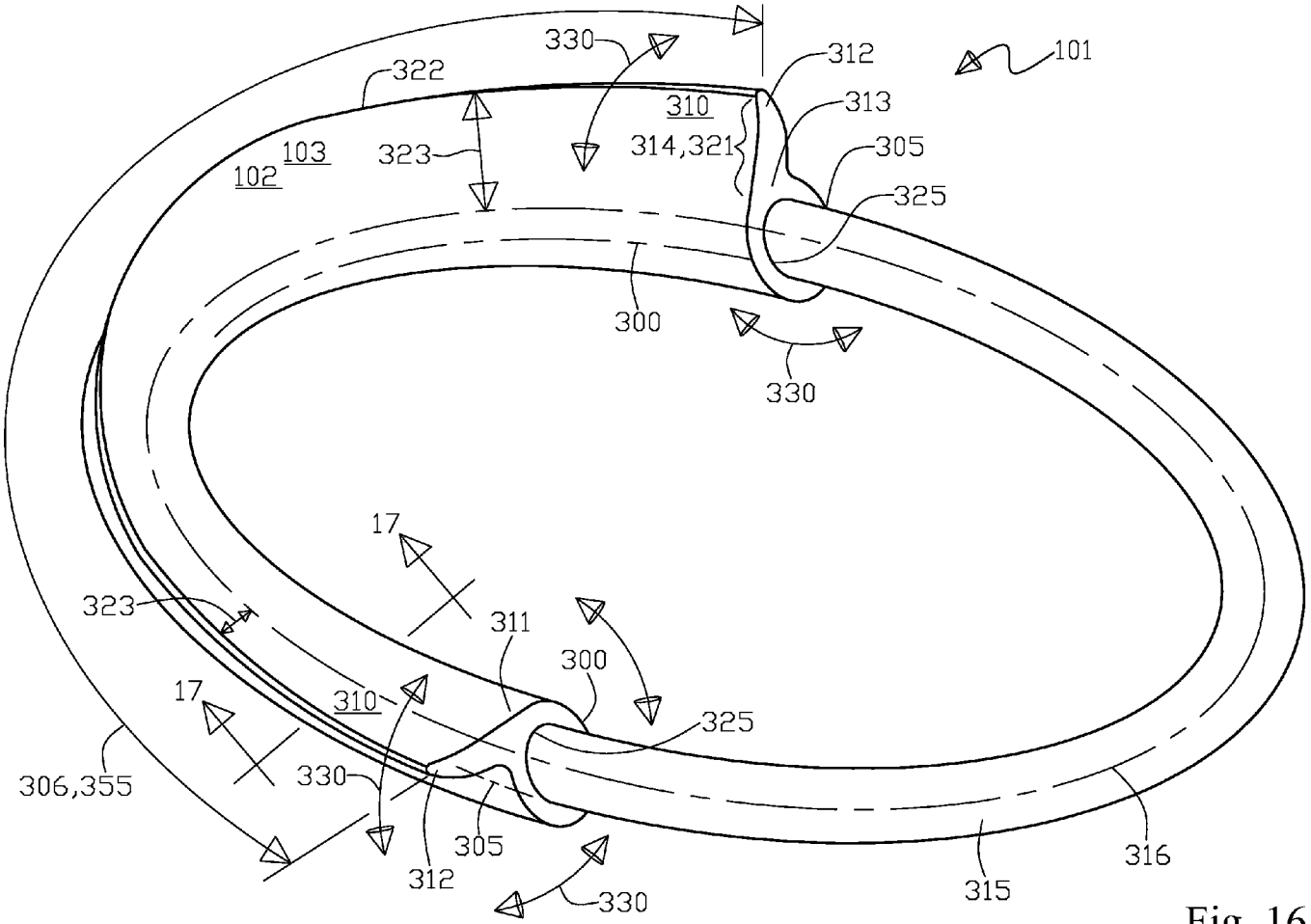
FIG. 16 shows a perspective view of a flexible heel rest that includes a flexible partial periphery arcuate chord segment structure having a radial arcuate section having an inner chord portion and an outer chord portion, the segment structure also having a radially outward extension in the form of a cantilever beam, the segment structure is shown circumferentially encompassing a substantially rigid static circular tube member that is affixed to the support base, the circumferentially encompassing segment structure has a slip fit relationship with the tube member, facilitating a pivotal movement of the segment structure about a circular long axis of the tube member, wherein the pivotal movement is resisted by the segment structure via the pivotal movement causing a circumferential compression stress being substantially parallel to the circular long axis in a circumferential compression area of the segment structure that is moving from the outer chord portion to the inner chord portion and a tensile stress being substantially parallel to the circular long axis in a tensile stress section that is moving from the inner chord portion to the outer chord portion.

Further, FIG. 16 shows a perspective view of a flexible heel rest 101 that includes a flexible partial periphery arcuate chord segment structure 102 having a radial arcuate section 103 having an inner chord portion 300 and an outer chord portion 305, the segment structure also having a radially outward extension 310 in the form of a cantilever beam, the segment structure 102 is shown circumferentially encompassing a substantially rigid static circular tube member 315 that is affixed to the support base 91. FIG. 16 also shows the circumferentially encompassing segment structure 102 has a slip fit 325 relationship with the tube member 315, facilitating a pivotal movement 330 of the segment structure 102 about a circular long axis 316 of the tube member 316, wherein the pivotal movement 330 is resisted by the segment structure 102 via the pivotal movement 330 causing a circumferential compression stress 335 being substantially parallel to the circular long axis 316 in a circumferential compression area of the segment structure 102 that is moving 340 from the outer chord portion 305 to the inner chord portion 300 and a tensile stress 345 being substantially parallel to the circular long axis 316 in a tensile stress section that is moving 350 from the inner chord portion 300 to the outer chord portion 305.

Figure 17:
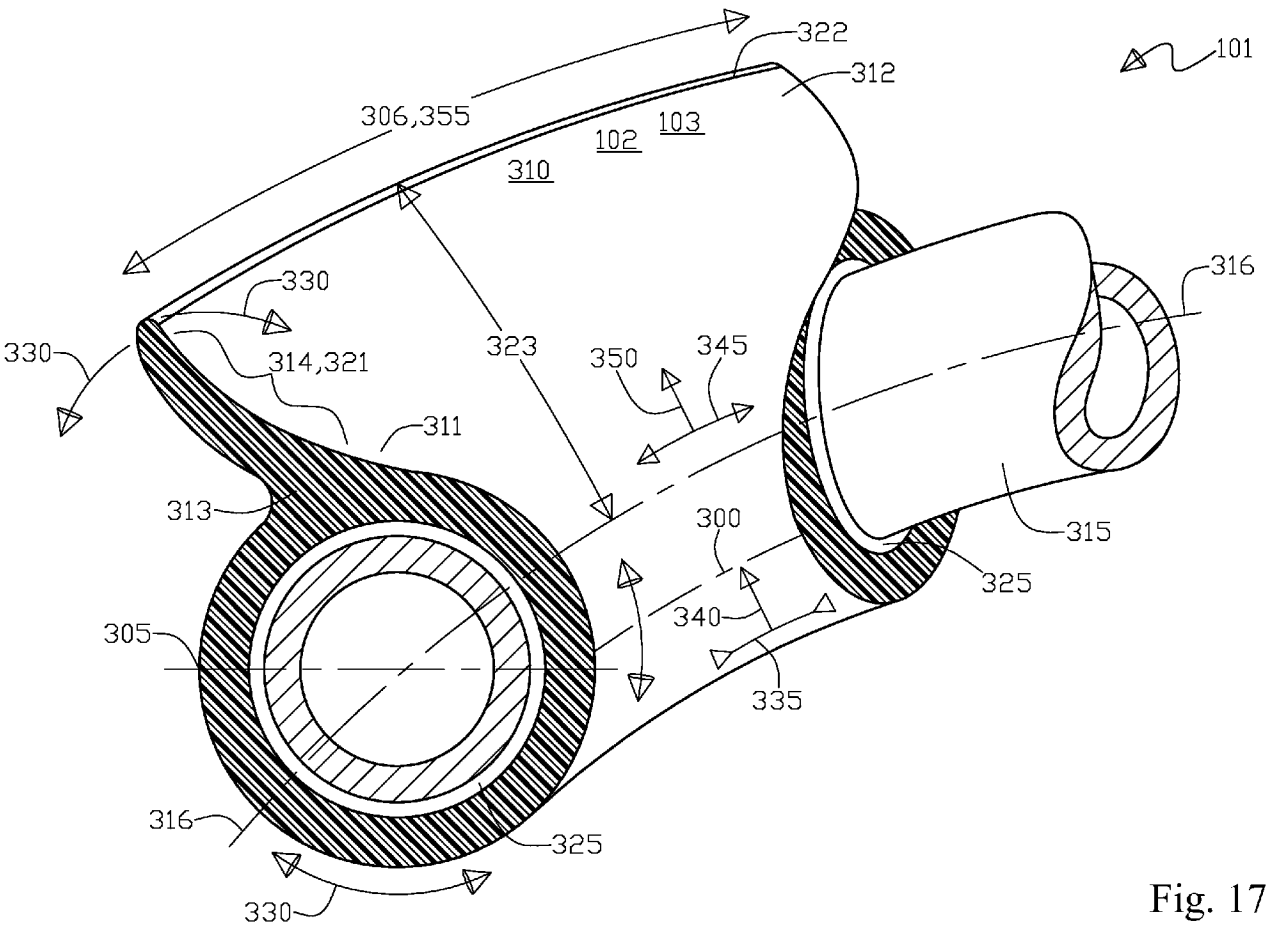
FIG. 17 is cross section 17-17 from FIG. 16 to show in detail the flexible partial periphery arcuate chord segment structure having the radial arcuate section having the inner chord portion and the outer chord portion, the segment structure also having the radially outward extension in the form of the cantilever beam, the segment structure is shown circumferentially encompassing the substantially rigid static circular tube member that is affixed to the support base, the circumferentially encompassing segment structure has the slip fit relationship with the tube member, facilitating the pivotal movement of the segment structure about the circular long axis of the tube member, wherein the pivotal movement is resisted by the segment structure via the pivotal movement causing the circumferential compression stress being substantially parallel to the circular long axis in the circumferential compression area of the segment structure that is moving from the outer chord portion to the inner chord portion and the tensile stress being substantially parallel to the circular long axis in the tensile stress section that is moving from the inner chord portion to the outer chord portion.

Continuing, FIG. 17 is cross section 17-17 from FIG. 16 to show in detail the flexible partial periphery arcuate chord segment structure 102 having the radial arcuate section 103 having the inner chord portion 300 and the outer chord portion 305, the segment structure 102 also having the radially outward extension 310 in the form of the cantilever beam, the segment structure 102 is shown circumferentially encompassing the substantially rigid static circular tube member 315 that is affixed to the support base 91. FIG. 17 also shows the circumferentially encompassing segment structure 102 has the slip fit 325 relationship with the tube member 315, facilitating the pivotal movement 330 of the segment structure about the circular long axis 316 of the tube member 315, wherein the pivotal movement 330 is resisted by the segment structure 102 via the pivotal movement 330 causing the circumferential compression stress 335 being substantially parallel to the circular long axis 316 in the circumferential compression area of the segment structure 102 that is moving 340 from the outer chord portion 305 to the inner chord portion 300 and the tensile stress 345 being substantially parallel to the circular long axis 316 in the tensile stress section that is moving 350 from the inner chord portion 305 to the outer chord portion 300.

Figure 18:
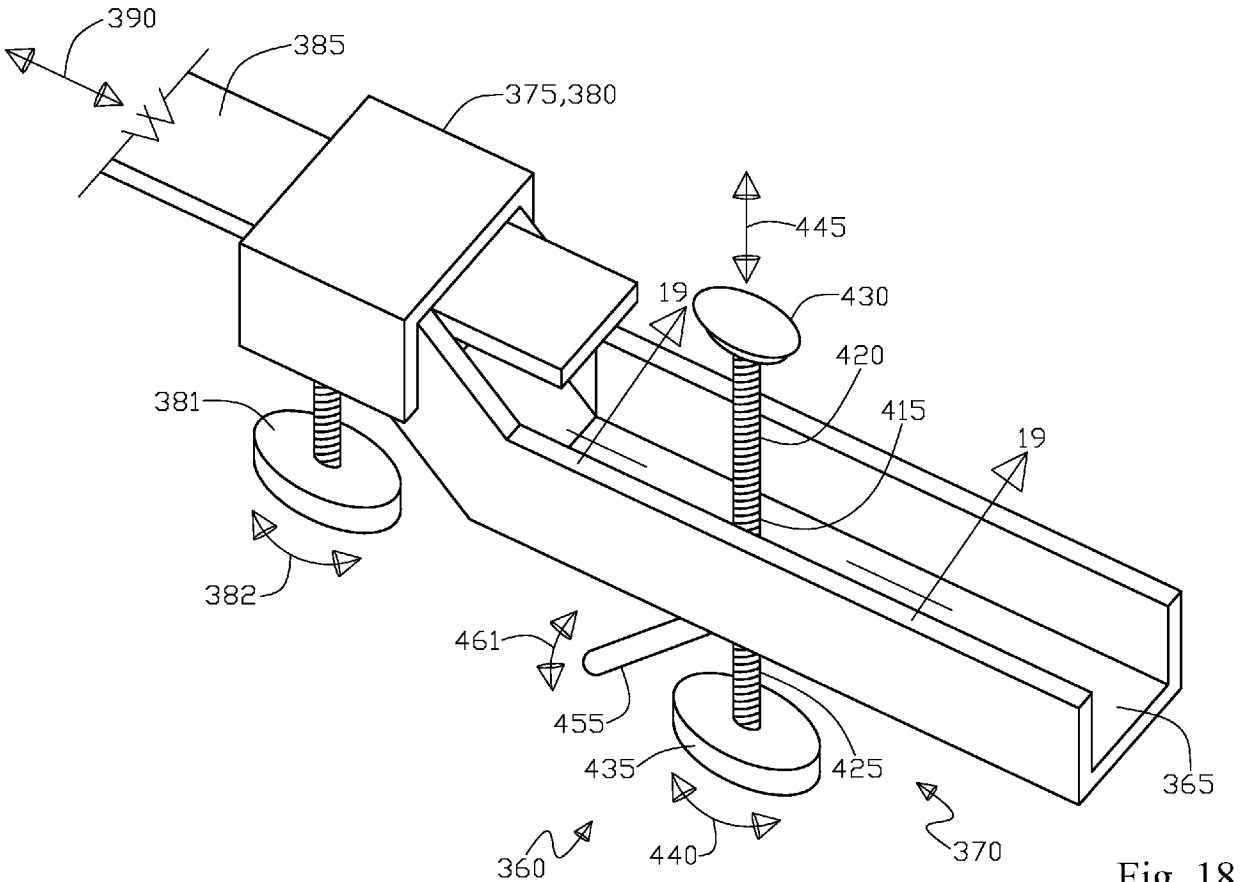
FIG. 18 shows a perspective view of the a seat angle adjustment apparatus that includes a selectable manual mechanism for adjusting the seat plane acute angle (not shown), the selectable manual mechanism includes a locking device that independently secures the seat plane acute angle (not shown) in a fixed angular orientation, also shown is a horizontal sliding selectable and locking clamp assembly that is affixed to the adjustment apparatus and is slidably and independently selectably lockably engaged to a back support element, wherein the horizontal sliding clamp assembly facilitates the back support element to be independently selectably lockable within a range of horizontal movement parallel to the surface (not shown)

Further, FIG. 18 shows a perspective view of a seat angle adjustment apparatus 360 that includes a selectable manual mechanism 365 for adjusting the seat plane acute angle 180, 445 (not shown), the selectable manual mechanism 365 includes a locking device 370 that independently secures the seat plane acute angle 180, 445 (see FIG. 10) in a fixed angular orientation, also shown is a horizontal sliding selectable and locking clamp assembly 375 that is affixed to the adjustment apparatus 360 and is slidably and selectably lockably engaged 380 to a back support element 385. FIG. 18 also shows the horizontal sliding clamp assembly 375 that facilitates the back support element 385 to be independently selectably lockable within a range of horizontal movement 390 parallel to the surface 210 (see FIG. 10).

Figure 19:
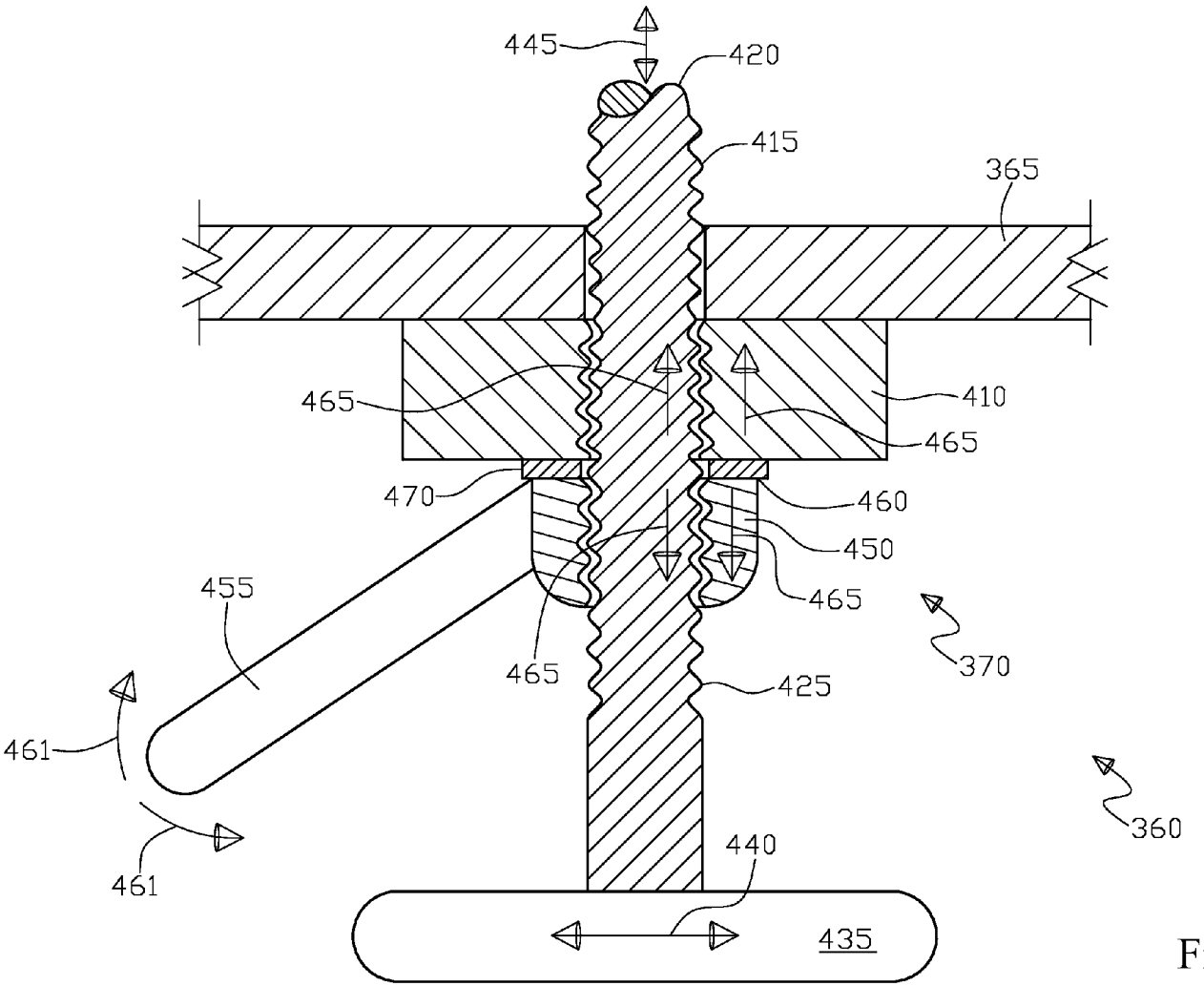
FIG. 19 shows cross sectional view 19-19 from FIG. 18 that includes the seat angle adjustment apparatus having an internally threaded element that threadably engages an externally threaded rod having a proximal end portion and a distal end portion, the threaded rod proximal end portion is pivotally and rotatably connected to the seat (not shown) and the threaded rod distal end portion has a handle attached for the user to grasp for rotating the threaded rod to adjust the seat plane acute angle (not shown), further shown is a seat angle adjustment apparatus locking device that includes a loose internally threaded body having a radially outward beam for the user to manually grasp and rotate or move, the loose internally threaded body also threadably engages the externally threaded rod that is positioned adjacent to the internally threaded element, wherein operationally once the seat plane acute angle is set (not shown) by the user via manually grasping and rotating the handle, the threaded body is then rotated or moved via the beam by the user manually grasping the beam to tightly contact the threaded element thus putting the threaded rod in axial tension to lock the threaded rod rotationally within the threaded element to selectively lock the seat plane acute angle (not shown) by the user, also shown is a high friction annular ring disposed therebetween the threaded element and the threaded body to allow the selective lock with less of the tightly contact as between the threaded element and the threaded body with less force required upon the radial outward beam for movement from the user's manual grasp.

Continuing, FIG. 19 shows cross sectional view 19-19 from FIG. 18 that includes the seat angle adjustment apparatus 360 having an internally threaded element 410 that threadably engages an externally threaded rod 415 having a proximal end portion 420 and a distal end portion 425, the threaded rod proximal end portion 420 is pivotally and rotatably connected 430, (see FIG. 10) to the seat 35 (also see FIG. 10) and the threaded rod 415 distal end portion 425 has a handle 435 attached for the user 215 to grasp for rotating 440 the threaded rod 415 to adjust the seat plane acute angle 180, 445 (see FIG. 10). Further shown in FIG. 19 is a seat angle adjustment apparatus locking device 370 that includes a loose internally threaded body 450 having a radially outward beam 455 for the user 215 to manually grasp and rotate or move 461, the loose internally threaded body 450 that also threadably engages the externally threaded rod 415 that is positioned adjacent to the internally threaded element 410. Thus in FIG. 19, operationally once the seat plane acute angle 180, 445 is set (see FIG. 10) by the user 215 via manually grasping and rotating 440 the handle 435, the threaded body 450 is then rotated or moved 461 via the beam 455 by the user 215 manually grasping the beam 455 to tightly contact 460 the threaded element 410 thus putting the threaded rod 415 in axial tension 465 to lock the threaded rod 415 rotationally 440 within the threaded element 410 to selectively lock the seat plane acute angle 180, 445 (see FIG. 10) by the user 215. Plus FIG. 19 shows a high friction annular ring 470 that is disposed therebetween the threaded element 410 and the threaded body 450 to allow the selective lock with less of the tightly contact 460 as between the threaded element 410 and the threaded body 450 with less force required upon the radial outward beam 455 for movement 461 from the user's 215 manual grasp.

Broadly, as best shown in FIGS. 8 through 12, the present invention is for a chair 30 that is adapted for a female anatomy 220; the chair 30 includes a seat 35 having a proximate end portion 40 and a distal end portion 45 that forms a first substantially convex arcuate profile 50 surface therebetween on the seat 35. The seat 35 also including a length 55 that is substantially parallel to the first substantially convex arcuate profile surface 50 and a distance 60 substantially transverse to the length 55, with the first substantially convex arcuate profile surface 50 formed from a first partial arc 70 of a first radius 65, the first radius 65 being greater than the length 55. In addition, the first substantially convex arcuate profile surface 50 includes a first seat tangential point 75 on the proximate end portion 40 and a second seat tangential point 80 on the distal end portion 45, wherein the first seat tangential point and the second seat tangential point are at a second distance 85 apart forming a seat plane 90, best shown in FIG. 10.

The concept here is that the length 55 is shorter than a conventional office chair seat to allow the user's 240 legs to angle 181 more toward the surface 210 with seat support focused in the area of the user's 240 hip joint as opposed to a longer more conventional seat 35 length 55, as shown in FIGS. 1 and 2, that would put pressure on the user's 240 leg just behind the knee, thus restricting the desired angle 181, as best shown in FIG. 11. In addition, the seat 35 convex arcuate profile surface 50 further facilitates angle 181, as the seat 35 surface 50 allows somewhat of a "roll off" i.e. the distal end portion 45 curves even more towards the surface 210 than does the seat 35 area adjacent to an intersection area 185 which would be more parallel to the angle 181, again see FIG. 11, as opposed to a conventional chair that has a relatively flat seat surface that is parallel to the surface 210, as shown in FIGS. 1 and 2.

Further included in the chair 30 that is adapted for a female anatomy 220 is a back 95 having a first end portion 100 and a second end portion 105, the first 100 and second 105 end portions forming a second substantially convex arcuate profile surface 110, the back 95 also including a dimension 115 substantially parallel to the second substantially convex arcuate profile surface 110 and a first measure 120 and a second measure 125 both being substantially transverse to the dimension 115, as best shown in FIGS. 8, 9, and 10. Wherein, the second measure 125 on the second end portion 105 is less than the first measure 120 on the first end portion 100, with the second substantially convex arcuate profile surface 110 formed from a second partial arc 135 of a second radius 130, the second radius 130 being greater than the dimension 115. In addition, the second substantially convex arcuate profile surface 110 including a first back tangential point 140 on the first portion 100 and a second back tangential point 145 on the second portion 105, wherein the first back tangential point 140 and the second back tangential point 145 are at a third distance 150 apart forming a backplane 155. As the back 95 is designed to nest into or adjacent to the small of the back 230 of the user 240, as shown in FIG. 11, thus with the back 95 being of minimal size to support the small of the back 230 while leaving a larger span 190 as between the seat 35 and the back 95 accommodating room for the somewhat swayback user 240 posture going from their hip joint to their lower back to allow for additional body adjustment movement to achieve what is shown in FIG. 11, primarily with the user's 240 shoulder joint and hip joint being in a vertical alignment 186 in moving more toward a better skeletal posture as shown in FIGS. 4, 5, 6, and 7.

Continuing on the chair 30 that is adapted for a female anatomy 220, the seat plane 90 and an extension axis 175 that is perpendicular to the surface 210 are relatively positioned to one another to form an acute angle 180 to one another at an intersection point 185 positioned therebetween the first seat tangential point 75 and the second seat tangential point 80. In addition the seat 35 and back 95 are relatively positioned such that a span 190 from the first seat tangential point 75 to the first back tangential point 140 is at least equal to half of the dimension 115, to accommodate the measurement distances 255, 250, and 265 based upon data taken as shown in FIGS. 13, 14, and 15 all as previously described, wherein the span 190 is a larger dimension i.e. the distance as between the seat 35 and back 95 is greater than a typical conventional chair, see FIG. 1, wherein the chair in FIG. 1 doesn't allow the user as much freedom of movement to adjust for better posture, further not allowing for hardly any buttocks 217 rearward clearance, thus aiding in promoting the undesirable slouching forward of the user's 215 back as previously described.

Preferably the seat 35 and back 95 are relatively positioned such that the span 190 from the first seat tangential point 75 to the first back tangential point 140 is about six (6) to nine (9) inches, based upon the data in FIGS. 13, 14, and 15, as opposed to a conventional office chair in FIG. 1, wherein the span is in the range of zero (0) to four (4) inches, that would severely restrict the freedom of movement as between desirable positioning of the user's 240 femur, pelvis, and back bone or spine. Continuing, on the back 95 positioning, based upon the data in FIGS. 13, 14, and 15, for the chair 30 adapted for a female anatomy 220 wherein the seat proximate end portion 40 and the maximum second radius extension portion 165 are positioned at a preferred distance 245 of about eight (8) to eleven (11) inches apart, as shown in FIG. 11, to best position the back 95 to be nested in the user's 240 small of their back 230. Further, in looking at the lateral positioning of the back 95, the chair 30 adapted for a female anatomy 220, wherein the seat proximate end portion 40 and the maximum second radius extension portion 165 are positioned with a preferable overlap distance 170 of about two (2) inches being parallel to the surface 210, as best shown in FIG. 7, as this is to better ensure positioning of the back 95 to be nested in the user's 240 small of their back 230, to better accommodate the desired shoulder joint and hip joint vertical in-line alignment 186, as shown in FIG. 11.

Alternatively looking at FIG. 10 in particular for the acute angle 180 for the chair 30 adapted for a female anatomy 220, the preferred acute angle 180 is in the range of about fifty-five to eighty-five (55-85) degrees. This particular range for the acute angle 180 is derived from FIGS. 2, 3, 4, 5, 6, and 7 and in particular FIGS. 2, 3, 4, and 5 for the sixty (60) degree range of Femur bone movement in the hip joint before the pelvis and back bone have to move (causing the previously described undesirable uneven spacing of the back bone disc sets), thus the sixty (60) degree movement falls within the range fifty-five to eighty-five (55-85) degrees for the acute angle 180. Also looking at FIGS. 6 and 7, the one hundred-thirty-five (135) degree angle for the Femur from the back bone would result in acute angle 180 being forty-five (45) degrees which is just out of the preferred range. However, there are practical considerations to make as when the user 240 is seated in the chair 30 as shown in FIGS. 11 and 12, to take the acute angle 180 to a lower number such as forty-five (45) degrees would risk the user 240 uncomfortably sliding forward out of the chair, even with a high friction surface seat 35 covering 200 and/or memory foam 205/or seat 35 surface sculpting for the user 240, thus the past need for the kneeling chair like Serber U.S. Pat. No. 4,650,259, as previously discussed in the field and background section, utilized knee and abdominal ancillary supports to better allow the complementary angle 181 (to acute angle 180) as shown in FIG. 11, such that as angle 181 is to be increased to beyond, for instance greater than thirty-five (35) degrees, wherein the user 240 could stay in the seat with these ancillary supports that add their own problems of cramping and soreness to the user from pressure against their knee and abdominal area used as supports.

Further, these ancillary supports were not popular with users as these ancillary supports caused additional problems with abdominal and knee cramping, nerve irritation, and just plain getting in the way in front of the desk, keyboard, computer, and the like, plus causing awkward and difficult movement to get in and out of the chair by the user 240. Thus the acute angle 180 preferred range of range fifty-five to eighty-five (55-85) degrees is the most practical while trying to allow for angle 181 to fall within the desired range of thirty-five (35) to five (5) degrees, with the ideal being thirty (30) degrees as per the Hanns Schoberth study previously discussed, for improved skeletal posture without the need for ancillary support devices as previously described that do not have much popularity. Further in a modified embodiment for the chair 30, the acute angle 180 could have a narrowed range of position of about seventy-five (75) to eighty-seven (87) degrees, thus resulting in complementary angle 181, in FIG. 7 being in the range of three (3) to fifteen (15) degrees.

As shown in FIGS. 8 through 12, 16, and 17, a support base 91 is disposed between the seat 35 and the surface 210, wherein the support base 91 has conventional castors, conventional vertical height adjustment, and further the flexible heel rest 101 that includes the flexible partial periphery chord segment structure 102, with the radial arcuate section 103, and further an angular 180 seat 35 adjustment that can be of a frictional clamping type, or a ratcheting mechanism, or a dowel pin that is received in a plurality apertures, or a suitable equivalent. Additionally, also as shown in FIGS. 8 through 12, a support structure 156 is disposed between the seat 35 and the back 95 that controls the positional relationship as between the seat 35 and the back 95 as previously described to effectuate the distance 245 and the horizontal measurement 250, via conventional adjustment mechanisms of frictional clamping, or dowel pins that are received in a plurality apertures, or a suitable equivalent.

Continuing to a number of preferred specifics for the chair 30 for a female anatomy 220 are the dimensions that are based upon the data gathered from FIGS. 13, 14, and 15 for the group of thirty (30) female participants the following is given; the length 55 is in the range of about thirteen (13) inches, noting that this dimension is shorter than a conventional office chair, which is in the range of eighteen to twenty (18-20) inches, to allow for the user's 240 knees to drop below their hips, as shown in FIGS. 11 and 12, as a first step toward minimizing the pelvis and backbone bending causing uneven disc loading as shown in FIGS. 2 and 3, thus moving toward the more ideal pelvis/backbone positioning shown in FIGS. 4 and 5. Further, on the chair 30 adapted for a female anatomy 220 the first distance 60 is in the range of about sixteen (16) inches, however, this first distance 60 could be a larger distance and not affect the function of the chair 30 and the second distance 85 is in the range of about eleven (11) inches, being the distance between the first tangential point 75 and the second tangential point 80 on the seat 35 that is used as intersection points to develop the seat plane 90.

Continuing, on the chair 30 adapted for a female anatomy 220 the dimension 115 is in the range of about seven (7) inches, noting that this is the height of the chair back 95, that is also smaller than a conventional office chair, that are in the range of eleven (11) to eighteen (18) inches, thus the present invention has a shorter back 95 for several reasons, being to accommodate a female anatomy 220 based upon the data in FIGS. 13, 14, and 15, and as previously discussed the desired function of the back 95 is to nest in the small of the back 230 of the user 240 dictating that the back is smaller than a conventional office chair, further this nesting of the back 95 in the small of the user's back 230 facilitates the skeletal posture approaching that of FIGS. 4 and 5. In accordance, on the back 95, the third distance 150 is in the range of about six (6) inches, being the distance between the first back tangential point 140 and the second back tangential point 145 to form the back plane 155.

Continuing on the back 95, as another feature unique to the female anatomy 220 also based upon the data in FIGS. 13, 14, and 15, the back is narrower at its upper or second end portion 105 to accommodate a narrower distance as between a female's shoulders and shoulder blades and to again allow for more freedom of movement in settling into the desired skeletal posture of FIGS. 4 and 5. Thus on the back 95 the first measure 120 is in the range of about twelve (12) inches as best shown in FIG. 9, and then transitioning 160 to the second measure 125 is in the range of about four (4) inches, which allows the females more narrowly spaced shoulder blades full freedom of movement as compared to a males wider spaced shoulder blades, noting that the conventional office chair has a back width in the range of twelve (12) to sixteen (16) inches typically without any narrowing at the upper portion being a consistent width over its entire height. Also, on the back 95, distance 270 in going from the maximum second radius extension portion 165 to the transition 160 defines on the back 95 the distance from the small of the back 230 of the user 240 to the start of the shoulder blades of the user 240, thus distance 270 is equal to distance 255 plus distance 265 less distance 245 which equals about two and one-half (2½) inches. Further, based upon the data in FIGS. 13, 14, and 15, for the chair adapted 30 for a female anatomy 220, preferably wherein the seat proximate end portion 40 and the transition 160 are positioned being the combination of 255 and 265 about fourteen (14) to seventeen (17) inches apart, as shown in FIG. 11.

A few other optional useful features of the chair 30 adapted for a female anatomy 220 would include a high friction surface 200 disposed upon the seat 35. Wherein the preferred materials of construction for the high friction surface 200 would include velvet, velour, a thick nap fabric, and the like to help resist the tendency for the user 240 to slide forward on the seat 35 due to the acute angle 180, and its complementary angle 181, as best shown in FIGS. 10 and 11 respectively. In addition, optionally, the seat 35 can include a memory foam 205 disposed upon the seat 35 as shown in FIG. 9, which could be combined with a sculpted seat again to better resist the tendency for the user 240 to slide forward on the seat 35 due to the acute angle 180, and its complementary angle 181, as best shown in FIGS. 10 and 11 respectively.

Referring to FIGS. 10, 11, 12, 16, and 17, the chair 30 adapted for the female anatomy can further comprise the flexible heel rest 101 that includes the flexible partial periphery arcuate chord segment structure 102 having the radial arcuate section 103 having the inner chord portion 300 and the outer chord portion 305. The segment structure 102 having the radially outward extension 310 in the form of the cantilever beam, the segment structure 102 is circumferentially encompassing the substantially rigid static circular tube member 315 that is affixed 320 to the support base 91, see FIG. 8. The circumferentially encompassing segment structure 102 has the slip fit 325 relationship with the tube member 315, facilitating the pivotal movement 330 of the segment structure 102 about the circular long axis 316 of the tube member 315, see FIGS. 16 and 17 in particular. Wherein, the pivotal movement 330 is resisted by the segment structure 102 by being preferably constructed of a resilient material that allows some degree of flexing, such as neoprene rubber, extruded PVC plastic, or a suitable equivalent. Wherein, the limited amount of flexing of the segment structure 102 is via the pivotal movement 330 causing the circumferential compression stress 335 to be resisted by the material thus being substantially parallel to the circular long axis 316 in the circumferential compression area of the segment structure 102 that is moving 340 from the outer chord portion 305 to the inner chord portion 300 and the circumferential tensile stress 345 being substantially parallel to the circular long axis 316 in a tensile stress section that is moving 350 from the inner chord portion 305 to the outer chord portion 300, again wherein the segment structure 102 material is resisting the circumferential tensile stress 345, all as best shown in FIGS. 16 and 17. Wherein operationally for a user's 215 heel 216 to rest against the segment structure 102 to accommodate a user's 215 knee 218 positioned closer to the surface 210, thus being below the user's 215 hip joint for comfort due to the seat plane 90 forward leaning angle 180, see FIG. 10, creating the downward seat 35 slope from the chair back 95, resulting in making the user's 215 foot 221 rotate 219 toward the surface 210 toes first, thus positioning the user's foot 221 bottom to being nearly perpendicular to the surface 210 to help drop the knee 218 to accommodate the seat plane 90 forward leaning angle 180 while at the same time providing for user 215 foot 221 comfort with the outward extension 310 having a user 215 foot 221 cushioning flexibility from the pivotal movement 330, see FIG. 12.

Further on the chair 30 adapted for the female anatomy the radially outward extension 310 has a preferred circumferential length 355 equal to a length 306 of the outer chord portion 305, see FIG. 16. Also, on the chair 30 adapted for a female anatomy the radially outward extension 310 has a proximal extension portion 311 and the opposing distal extension portion 312, with the proximal extension portion 311 being affixed 313 adjacent to the outer chord portion 305 extending in an arched shape 314 toward the distal extension portion 312, wherein the arched shape 314 angles 321 towards the seat 35, see FIGS. 10, 11, 12, 16, and 17. In addition, alternatively, for the chair 30 adapted for the female anatomy the distal extension portion 312 terminates in an arcuate ridge 322 that is parallel 323 to the circular long axis 316 for user 215 foot comfort in selecting multiple heel 216 positions along the arcuate ridge 322, see FIGS. 12, 16, and 17.

Referring to FIGS. 10, 11, 12, 18, and 19, the seat angle adjustment apparatus 360 is attached therebetween the support base 91 and the seat 35, with the seat angle adjustment apparatus 360 including the selectable manual mechanism 365 for adjusting the seat plane acute angle 180, 445, see FIG. 10. The selectable manual mechanism 365 includes a locking device 370 that independently secures the seat plane acute angle 180, 445 in a fixed angular orientation, again see FIG. 10. Further, the horizontal sliding selectable and locking clamp assembly 375 is affixed to the adjustment apparatus 360 and is slidably and selectably lockably engaged 380 to the back support element 385, wherein the horizontal sliding clamp assembly 375 facilitates the back support element 385 to be independently selectably lockable within a range of horizontal movement 390 parallel to the surface 210, see in particular FIGS. 10 and 18. Further, a handle 381 is utilized to make the independent selectable and slidable engagement 380 via rotating 382 the handle 381.

Also, looking at FIGS. 10, 11, and 12, a vertical sliding selectable and locking clamp assembly 395 is affixed to back 95 and is slidably and selectably lockably engaged 400 to the back support element 385 to facilitate independent vertical movement 405 of the back 95 that is independently selectably lockable within a range of vertical movement 405 perpendicular to the surface 210. Further, a handle 401 is utilized to make the independent selectable and slidable engagement 400 via rotating 402 the handle 401.

Referring in particular to FIGS. 10, 11, 12, 18, and 19, the seat angle adjustment apparatus 360 further includes the internally threaded element 410 that threadably engages the externally threaded rod 415 having the proximal end portion 420 and the distal end portion 425, wherein the threaded rod 415 proximal end portion 420 is pivotally and rotatably connected 430 to the seat 35 and the threaded rod 415 distal end portion 425 has a handle 435 attached for the user 215 to grasp for rotating 440 the threaded rod 415 to adjust the seat plane acute angle 180, 445, see FIGS. 10, 18, and 19.

Looking at FIGS. 10, 18, and 19, the seat angle adjustment apparatus 360 can further include the locking device 370 that has the loose internally threaded body 450 having the radially outward beam 455 for the user 215 to grasp, wherein the loose internally threaded body 450 also threadably engages the externally threaded rod 415 adjacent to the internally threaded element 410, see FIG. 19 in particular. Wherein operationally once the seat plane acute angle 180, 455 is set by the user 215 via the handle 435, see FIG. 10, the threaded body 450 is then rotated 461 via the beam 455 to tightly contact 460 the threaded element 410 thus putting the threaded rod 415 in axial tension 465 to lock the threaded rod 415 rotationally 440 within the threaded element 410 to independently and selectively lock the seat plane acute angle 180, 445 by the user 215, see FIGS. 10 and 19. In addition, also looking at FIGS. 10 and 19, an optional high friction annular ring 470 is disposed therebetween the threaded element 410 and the threaded body 450 to allow the independent selective lock with less of the tightly contact 460 as between the threaded element 410 and the threaded body 450 with less force required upon the radial outward beam 455 for movement 461 from the user's 215 manual grasp. Thus the high friction annular ring 470 being in the form of a washer, as shown in FIGS. 10 and 19, can be constructed of an elastomer or a metal or plastic with surfaces having multiple protrusions to enhance the rotational frictional gripping contact 460 as between the body 450 and the threaded element 410.

Method of Use

Referring in particular to FIGS. 4, 5, 6, 7, 11, and 12, a method of using a chair 30 adapted for a female anatomy 220, wherein the chair 30 is adjacent to a surface 210 is disclosed, comprising the steps of: firstly providing a chair 30 as previously described. A next step of adjusting the seat plane 90 to an extension axis 175 that is perpendicular to the surface 210 such that they are relatively positioned to one another to form an acute angle 180 from between about fifty-five (55) to eighty-five (85) degrees to one another, wherein the angle 180 is taken at an intersection point 185 positioned therebetween the first seat tangential point 75 and the second seat tangential point 80. The determination of the angle 180 will be based upon a user's leg length 225, seat height above the surface 235, and the user's comfort level in said adjusting of the angle 180 in not uncomfortably sliding forward on the inclined seat 35, however as also previously discussed the ideal angle 180 is sixty (60) degrees for zero pelvis and lumbar backbone flexing meaning that the discs are not unevenly loaded as previously discussed, however, even if the user 240 has some sliding forward discomfort, they should set the angle 180 as close to sixty (60) degrees as possible for maximum posture benefit, see FIGS. 10 and 11.

A further step of adjusting the seat 35 and back 95 such that they are relatively positioned to one another to result in a selected span 190 from the first seat tangential point 75 to the first back tangential point 140, the selected span 190 being based upon the user 240 sitting in the chair 30 after completing the previous angle 180 adjusting step and measuring a distance 245 from the first seat tangential point 75 to a small 230 of the back of the user 240, wherein the maximum second radius extension portion 165 is positioned to be in contact with the small 230 of the back of the user 240 at the selected span 190, as shown in FIGS. 11 and 12. A next step of laterally adjusting the maximum second radius extension portion 165 in a selected measurement 250 parallel to the surface 210 to be positioned in contact with the small 230 of the back of the user 240 while the user is 240 sitting in the chair 30 after completing the angle 180 adjusting step and the span 190 adjusting step, as best shown in FIGS. 11 and 12, wherein as previously described the maximum second radius extension portion 165 is to be nested in the small 230 of the back of the user 240 to facilitate the user's shoulder joint and hip joint to be in vertical alignment 186 as best shown in FIGS. 11 and 12.

CONCLUSION

Accordingly, the present invention of a chair apparatus adapted for a female anatomy and method of using the same has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

The invention claimed is:

1. A chair adapted for a female anatomy, wherein said chair is adjacent to a support surface, comprising:

(a) a seat having a proximate end portion and a distal end portion forming a first substantially convex arcuate profile surface there between, said seat also including a length substantially parallel to said first substantially convex arcuate profile surface and a first distance substantially transverse to said length, said first substantially convex arcuate profile surface formed from a first partial arc of a first radius, said first radius being greater than said length, in addition said first substantially convex arcuate profile surface including a first seat tangential point on said proximate end portion and a second seat tangential point on said distal end portion, wherein said first seat tangential point and said second seat tangential point are at a second distance apart forming a seat plane;

(b) a back having a first end portion and a second end portion, said first and second end portions forming a second substantially convex arcuate profile surface, said back also including a dimension substantially parallel to said second substantially convex arcuate profile surface and a first measure and a second measure both being substantially transverse to said dimension, wherein said second measure on said second end portion is about one-third of said first measure on said first end portion, this is to accommodate a nonbinding movement of a users narrowed shoulder blades from an arched back posture from a seat plane forward leaning angle, said second substantially convex arcuate profile surface formed from a second partial arc of a second radius, said second radius being greater than said dimension, in addition said second substantially convex arcuate profile surface including a first back tangential point on said first portion and a second back tangential point on said second portion, wherein said first back tangential point and said second back tangential point are at a third distance apart forming a backplane;

(c) said seat plane and an extension axis that is perpendicular to the support surface are relatively positioned to one another to form an acute angle to one another at an intersection point positioned therebetween said first seat tangential point and said second seat tangential point, said acute angle is in the range of about fifty-five to eighty-five degrees;

(d) said seat and back are relatively positioned such that a span from said first seat tangential point to said first back tangential point is about six to nine inches, to facilitate room for a user's arched back buttocks protrusion clearance caused from said seat plane forward leaning angle creating a downward seat slope from said chair back;

(e) a support base disposed between said seat and the support surface;

(f) a seat angle adjustment apparatus attached therebetween said support base and said seat, said seat angle adjustment apparatus includes a selectable manual mechanism for independently adjusting said seat plane acute angle, said selectable manual mechanism includes a locking device that independently secures said selected seat plane acute angle in a fixed angular orientation, said seat angle adjustment apparatus further includes an internally threaded element that threadably engages an externally threaded rod having a proximal end portion and a distal end portion, said threaded rod proximal end portion is pivotally and rotatably connected to said seat and said threaded rod distal end portion has a handle attached for the user to grasp for rotating said threaded rod to adjust said seat plane acute angle, said seat angle adjustment apparatus locking device includes a loose internally threaded body having a radially outward beam for the user to grasp, said loose internally threaded body also threadably engages said externally threaded rod adjacent to said internally threaded element, wherein operationally once said seat plane acute angle is set by the user via said handle, said threaded body is then rotated via said beam to tightly contact said threaded element thus putting said threaded rod in axial tension to lock said threaded rod rotationally within said threaded element to selectively lock said seat plane acute angle by the user;

(g) a horizontal sliding selectable and locking clamp assembly that is affixed to said adjustment apparatus and is slidably and selectably lockably engaged to a back support element, wherein said horizontal sliding clamp assembly facilitates said back support element to be independently selectably lockable within a range of horizontal movement parallel to the support surface; and (h) a vertical sliding selectable and locking clamp assembly that is affixed to said back and is slidably and selectably lockably engaged to said back support element to facilitate independent vertical movement of said back that is independently selectably lockable within a range of vertical movement perpendicular to the support surface.

2. A chair adapted for a female anatomy according to claim 1 further comprising a high friction annular ring disposed therebetween said threaded element and said threaded body to allow said selective lock with less of said tightly contact.

3. A chair adapted for a female anatomy according to claim 1, wherein said dimension is in the range of about seven inches.

4. A chair adapted for a female anatomy according to claim 3, wherein said third distance is in the range of about six inches.

5. A chair adapted for a female anatomy, wherein said chair is adjacent to a support surface, comprising:

(a) a seat having a proximate end portion and a distal end portion forming a first substantially convex arcuate profile surface there between, said seat also including a length substantially parallel to said first substantially convex arcuate profile surface and a first distance substantially transverse to said length, said first substantially convex arcuate profile surface formed from a first partial arc of a first radius, said first radius being greater than said length, in addition said first substantially convex arcuate profile surface including a first seat tangential point on said proximate end portion and a second seat tangential point on said distal end portion, wherein said first seat tangential point and said second seat tangential point are at a second distance apart forming a seat plane;

(b) a back having a first end portion and a second end portion, said first and second end portions forming a second substantially convex arcuate profile surface, said back also including a dimension substantially parallel to said second substantially convex arcuate profile surface and a first measure and a second measure both being substantially transverse to said dimension, wherein said second measure on said second end portion is about one-third of said first measure on said first end portion, this is to accommodate a nonbinding movement of a users narrowed shoulder blades from an arched back posture from a seat plane forward leaning angle, said second substantially convex arcuate profile surface formed from a second partial arc of a second radius, said second radius being greater than said dimension, in addition said second substantially convex arcuate profile surface including a first back tangential point on said first portion and a second back tangential point on said second portion, wherein said first back tangential point and said second back tangential point are at a third distance apart forming a backplane;

(c) said seat plane and an extension axis that is perpendicular to the support surface are relatively positioned to one another to form an acute angle to one another at an intersection point positioned therebetween said first seat tangential point and said second seat tangential point;

(d) said seat and back are relatively positioned such that a span from said first seat tangential point to said first back tangential point is about six to nine inches, to facilitate room for a user's arched back buttocks protrusion clearance caused from said seat plane forward leaning angle creating a downward seat slope from said chair back;

(e) a support base disposed between said seat and the support surface;

(f) a seat angle adjustment apparatus attached therebetween said support base and said seat, said seat angle adjustment apparatus includes a selectable manual mechanism for independently adjusting said seat plane acute angle, said selectable manual mechanism includes a locking device that independently secures said selected seat plane acute angle in a fixed angular orientation;

(g) a horizontal sliding selectable and locking clamp assembly that is affixed to said adjustment apparatus and is slidably and selectably lockably engaged to a back support element, wherein said horizontal sliding clamp assembly facilitates said back support element to be independently selectably lockable within a range of horizontal movement parallel to the support surface;

(h) a vertical sliding selectable and locking clamp assembly that is affixed to said back and is slidably and selectably lockably engaged to said back support element to facilitate independent vertical movement of said back that is independently selectably lockable within a range of vertical movement perpendicular to the support surface; and (i) a flexible heel rest that includes a flexible partial periphery arcuate chord segment structure having a radial arcuate section with an inner chord portion and an outer chord portion, said segment structure having a radially outward extension in the form of a cantilever beam, said segment structure is circumferentially encompassing a substantially rigid static circular tube member that is affixed to said support base, said circumferentially encompassing segment structure has a slip fit relationship with said tube member, facilitating a pivotal movement of said segment structure about a circular long axis of said tube member, wherein said pivotal movement is resisted by said segment structure via said pivotal movement causing a circumferential compression stress being substantially parallel to said circular long axis in a circumferential compression area of said segment structure that is moving from said outer chord portion to said inner chord portion and a circumferential tensile stress being substantially parallel to said circular long axis in a tensile stress section that is moving from said inner chord portion to said outer chord portion, wherein operationally for a user's heel to rest against said segment structure to accommodate a user's knee positioned closer to the support surface thus being below their hip joint for comfort due to said seat plane forward leaning angle creating said downward seat slope from said chair back, resulting in making a user's foot rotate toward the support surface toes first, thus positioning a user's foot bottom to being nearly perpendicular to the support surface.

6. A chair adapted for a female anatomy according to claim 5 wherein said radially outward extension has a circumferential length equal to a length of said outer chord portion.

7. A chair adapted for a female anatomy according to claim 6 wherein said radially outward extension has a proximal extension portion and an opposing distal extension portion, said proximal extension portion is affixed adjacent to said outer chord portion extending in an arched shape toward said distal extension portion, wherein said arched shape angles towards said seat.

8. A chair adapted for a female anatomy according to claim 7 wherein said distal extension portion terminates in an arcuate ridge that is parallel to said circular long axis.

* * * * *